US009896909B2

(12) United States Patent
Williamson, Jr.

(10) Patent No.: US 9,896,909 B2
(45) Date of Patent: Feb. 20, 2018

(54) DOWNHOLE ADJUSTABLE STEAM INJECTION MANDREL

(71) Applicant: Halliburton Energy Services, Inc., Houston, TX (US)

(72) Inventor: Jimmie Robert Williamson, Jr., Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 169 days.

(21) Appl. No.: 14/785,813

(22) PCT Filed: May 15, 2013

(86) PCT No.: PCT/US2013/041219
§ 371 (c)(1),
(2) Date: Oct. 20, 2015

(87) PCT Pub. No.: WO2014/185907
PCT Pub. Date: Nov. 20, 2014

(65) Prior Publication Data

US 2016/0076338 A1 Mar. 17, 2016

(51) Int. Cl.

| | |
|---|---|
| ***E21B 43/24*** | (2006.01) |
| ***E21B 34/14*** | (2006.01) |
| ***E21B 23/00*** | (2006.01) |
| ***E21B 34/12*** | (2006.01) |
| *E21B 34/00* | (2006.01) |

(52) U.S. Cl.
CPC ..... *E21B 34/14* (2013.01); *E21B 23/006* (2013.01); *E21B 34/12* (2013.01); *E21B 43/24* (2013.01); *E21B 2034/007* (2013.01)

(58) Field of Classification Search
CPC ..... E21B 43/24; E21B 43/2406; E21B 2034/007; E21B 34/14; E21B 23/06
See application file for complete search history.

(56) References Cited

U.S. PATENT DOCUMENTS

| | | | |
|---|---|---|---|
| 4,385,664 | A | 5/1983 | Hutchison |
| 4,524,825 | A | 6/1985 | Fore |
| 4,548,265 | A | 10/1985 | Luke |
| 4,662,452 | A | 5/1987 | Ross et al. |
| 4,745,943 | A | 5/1988 | Mortensen |
| 5,090,481 | A | 2/1992 | Pleasants et al. |
| 5,168,931 | A | 12/1992 | Caskey et al. |

(Continued)

FOREIGN PATENT DOCUMENTS

| | | | |
|---|---|---|---|
| EP | 0692610 | A2 | 1/1996 |
| WO | 2011/084233 | A2 | 7/2011 |

OTHER PUBLICATIONS

International Search Report and Written Opinion issued in related PCT Application No. PCT/US2013/041219 dated Feb. 14, 2014, 12 pages.

(Continued)

*Primary Examiner* — Cathleen R Hutchins
(74) *Attorney, Agent, or Firm* — Scott Richardson; Baker Botts L.L.P.

(57) ABSTRACT

A steam injection mandrel comprises a housing generally defining an axial flow bore and comprising one or more ports, an inner mandrel disposed within the housing, and a slot formed in the inner mandrel. The slot transitions at least three hundred sixty degrees about the longitudinal axis of the housing, and the steam injection mandrel is configured to provide fluid communication between the axial flow bore and the one or more ports through the slot.

20 Claims, 12 Drawing Sheets

(56) References Cited

U.S. PATENT DOCUMENTS

| | | | | |
|---|---|---|---|---|
| 5,180,007 | A | 1/1993 | Manke et al. | |
| 5,429,150 | A | 7/1995 | Siefers, Jr. | |
| 5,529,126 | A | 6/1996 | Edwards | |
| 5,735,350 | A | 4/1998 | Longbottom et al. | |
| 6,009,942 | A | 1/2000 | Williamson | |
| 6,273,195 | B1 | 8/2001 | Hauck et al. | |
| 6,845,817 | B2 | 1/2005 | Schraub | |
| 7,011,161 | B2 | 3/2006 | Ring et al. | |
| 7,032,673 | B2 | 4/2006 | Dezen et al. | |
| 7,066,264 | B2 | 6/2006 | Bissonnette et al. | |
| 7,350,577 | B2 | 4/2008 | Howard et al. | |
| 7,543,634 | B2 | 6/2009 | Fehr et al. | |
| 7,628,213 | B2 | 12/2009 | Telfer | |
| 7,870,908 | B2 * | 1/2011 | Mandrou | E21B 34/10 166/321 |
| 2004/0154806 | A1 | 8/2004 | Bode et al. | |
| 2010/0025047 | A1 | 2/2010 | Sokol et al. | |
| 2011/0139453 | A1 | 6/2011 | Schultz et al. | |
| 2012/0193106 | A1 | 8/2012 | Schultz et al. | |
| 2012/0199353 | A1 * | 8/2012 | Fermaniuk | E21B 34/14 166/305.1 |
| 2013/0025882 | A1 | 1/2013 | Streich et al. | |
| 2013/0186623 | A1 * | 7/2013 | Waterhouse | E21B 43/12 166/272.3 |
| 2015/0211316 | A1 * | 7/2015 | Skjeie | E21B 27/04 166/99 |

OTHER PUBLICATIONS

Office Action issued in related Canadian Application No. 2,909,423, dated Sep. 23, 2016 (4 pages).

* cited by examiner

DOWNHOLE ADJUSTABLE STEAM INJECTION MANDREL

CROSS-REFERENCE TO RELATED APPLICATION

The present application is a U.S. National Stage Application of International Application No. PCT/US2013/041219 filed May 15, 2013, which is incorporated herein by reference in its entirety for all purposes.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Many reservoirs containing vast quantities of oil have been discovered in subterranean formations; however, the recovery of oil from some subterranean formations has been very difficult due to the relatively high viscosity of the oil and/or the presence of viscous tar sands in the formations. In particular, when a production well is drilled into a subterranean formation to recover oil residing therein, often little or no oil flows into the production well even if a natural or artificially induced pressure differential exits between the formation and the well. To overcome this problem, various thermal recovery techniques have been used to decrease the viscosity of the oil and/or the tar sands, thereby making the recovery of the oil easier.

One such thermal recovery technique utilizes steam to thermally stimulate viscous oil production by injecting steam into a wellbore to heat an adjacent subterranean formation. Conventional steam injections tools, systems, and/or methods may provide steam injection at a predetermined constant flow rate to stimulate viscous oil production. Further, the steam is typically injected such that it is not evenly distributed throughout the well bore, resulting in a temperature gradient along the well bore. The cold spots may lead to the formation of condensation within a steam injection tool and thereby form water deposits within the steam injection tool and/or a wellbore. As such, there is a need for apparatuses, systems, and methods of increasing the efficiency and performance of a steam injection operation, as well as, controlling the water deposits generated by condensation during a steam injection operation.

SUMMARY

In an embodiment, a steam injection mandrel comprises a housing generally defining an axial flow bore and comprising one or more ports, an inner mandrel disposed within the housing, and a slot formed in the inner mandrel. The slot transitions at least three hundred sixty degrees about the longitudinal axis of the housing, and the steam injection mandrel is configured to provide fluid communication between the axial flow bore and the one or more ports through the slot. The steam injection mandrel may also include an annular region defined between an interior surface of the housing and an exterior surface of the inner mandrel, and a valve sleeve disposed within the annular region. The valve sleeve may be configured to selectively adjust a resistance to fluid flow between the axial flow bore and the one or more ports. The valve sleeve may be configured to be positioned to partially restrict or substantially restrict a route of fluid communication via the ports. The inner mandrel may comprise a helical slot, the helical slot may comprise a ported cover. The steam injection mandrel may also include an adjustment mechanism coupled to the valve sleeve, and the adjustment mechanism may be configured to position the valve sleeve. The adjustment mechanism may comprise a ratchet mechanism comprising a plurality of continuous slots. The slot may comprise one or more decision paths, and the slot may be configured to guide an adjustment tool into engagement with the ratchet mechanism. The adjustment mechanism may comprises a continuous j-slot coupled to a valve sleeve, the valve sleeve may be configured to selectively adjust a resistance to fluid flow between the axial flow bore and the one or more ports. The one or more ports may be in fluid communication with an exterior of the steam injection mandrel.

In an embodiment, a wellbore system comprises a tubular string having an axial flow bore disposed in a wellbore within a subterranean formation, and a downhole adjustable steam injection mandrel coupled to the tubular string. The downhole adjustable steam injection mandrel comprises an adjustment mechanism comprising a plurality of continuous slots coupled to a valve sleeve, and the valve sleeve is configured to selectively adjust a resistance to fluid flow between the axial flow bore and the subterranean formation. The axial flow bore may be configured to receive an adjustable selector tool, and the adjustable selector tool may be configured to engage one of the plurality of continuous slots and selectively increase or decrease the resistance to fluid flow between the axial flow bore and the subterranean formation. The system may also include one or more packers disposed about the tubular string, and the one or more packers may be configured to isolate one or more portions of the wellbore. The adjustment mechanism may comprise a ratchet mechanism that is configured to rotate in response to an axial cycling of an adjustable selector tool. The valve sleeve may be configured to axial translate in response to a rotation of the ratchet mechanism.

In an embodiment, a wellbore servicing method comprises disposing an adjustable selector tool within an axial flow bore of a downhole adjustable steam injection mandrel, engaging a continuous slot in an adjustment mechanism, rotating the adjustment mechanism using the adjustable selector tool, and selectively adjusting a resistance to the flow of a fluid between the axial flow bore and a subterranean formation in response to rotating the adjustment mechanism. Engaging the continuous slot in the adjustment mechanism may comprises: engaging the adjustable selector tool with a helical slot disposed in an inner mandrel of the downhole adjustable steam injection mandrel; and guiding the adjustable selector tool into engagement with the continuous slot using the helical slot. The adjustment mechanism may comprise a second continuous slot, and guiding the adjustable selector tool into engagement with the continuous slot using the helical slot may comprise: traversing one or more decision paths leading to the second continuous slot. Rotating the adjustment mechanism may comprise: axially cycling the adjustment mechanism; and rotating the adjustment mechanism in response to the axial cycling. The method may also include passing any liquid flowing along an interior surface of the axial flow bore through an axial discontinuity in an inner mandrel of the downhole adjustable steam injection mandrel. The axial discontinuity may comprise a helical slot disposed in the inner mandrel.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
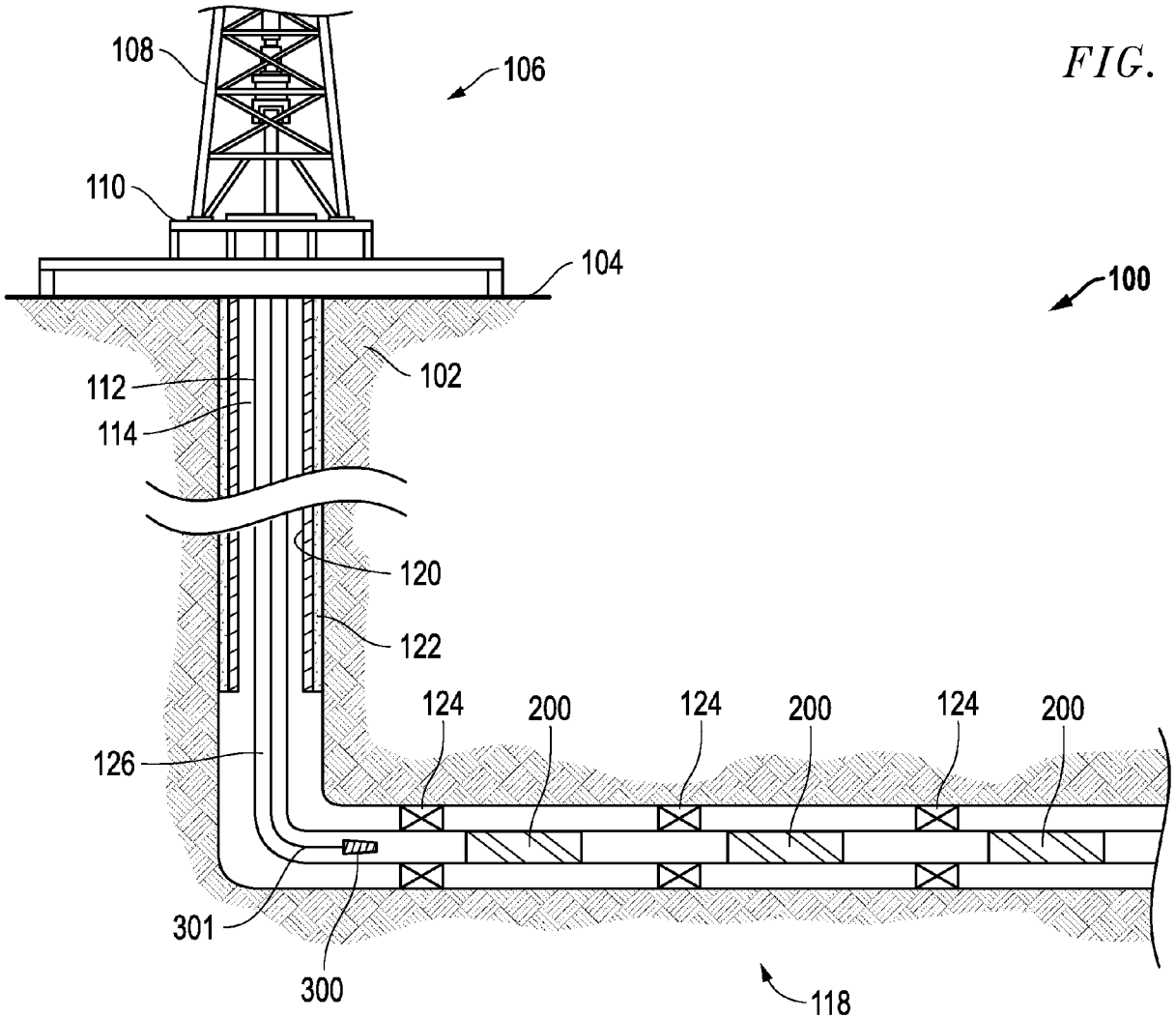
FIG. 1 is a partial cutaway view of an embodiment of an operating environment associated with a downhole adjustable steam injection mandrel tool.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "downhole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of wellbore servicing apparatuses, systems and methods of using the same. Particularly disclosed herein are one or more embodiments of a wellbore servicing tool, systems, and methods utilizing the same. In an embodiment, the wellbore servicing system may generally comprise a downhole adjustable steam injection mandrel (DASIM) 200 and an adjustable selector tool (AST) 300, as will be disclosed herein. In one or more of the embodiments as will be disclosed herein, the wellbore servicing system may be generally configured to selectively adjust the flow rate of fluid communication between an interior portion and an exterior portion of the DASIM 200, for example, during the performance of a wellbore servicing operation (e.g., a subterranean formation stimulation operation).

Referring to FIG. 1, an embodiment of an operating environment in which a wellbore servicing system 100 is illustrated. As depicted in FIG. 1, the operating environment generally comprises a wellbore 114 that penetrates a subterranean formation 102 for the purpose of recovering hydrocarbons, storing hydrocarbons, disposing of carbon dioxide, or the like. The wellbore 114 may be drilled into the subterranean formation 102 using any suitable drilling technique. In an embodiment, a drilling or servicing rig 106 disposed at the surface 104 comprises a derrick 108 with a rig floor 110 through which a work string (e.g., a drill string, a tool string, a segmented tubing string, a jointed tubing string, or any other suitable conveyance, or combinations thereof) generally defining an axial flow bore 126 may be positioned within or partially within wellbore 114. In an embodiment, such a work string may comprise two or more concentrically positioned strings of pipe or tubing (e.g., a first work string may be positioned within a second work string). The drilling or servicing rig may be conventional and may comprise a motor driven winch and other associated equipment for lowering the work string into wellbore 114. Alternatively, a mobile workover rig, a wellbore servicing unit (e.g., coiled tubing units), or the like may be used to lower the work string into the wellbore 114. In such an embodiment, the work string may be utilized in drilling, stimulating, completing, or otherwise servicing the wellbore, or combinations thereof.

The wellbore 114 may extend substantially vertically away from the earth's surface over a vertical wellbore portion, or may deviate at any angle from the earth's surface 104 over a deviated or horizontal wellbore portion 118. In alternative operating environments, portions or substantially all of wellbore 114 may be vertical, deviated, horizontal, and/or curved and such wellbore may be cased, uncased, or combinations thereof. In some instances, at least a portion of the wellbore 114 may be lined with a casing 120 that is secured into position against the formation 102 in a conventional manner using cement 122. In this embodiment, the deviated wellbore portion 118 includes casing 120. However, in alternative operating environments, the wellbore 114 may be partially cased and cemented thereby resulting in a portion of the wellbore 114 being uncased. In an embodiment, a portion of wellbore 114 may remain uncemented, but may employ one or more packers 124 (e.g., mechanical and/or swellable packers, such as Swellpackers™, commercially available from Halliburton Energy Services, Inc.) to isolate two or more adjacent portions or zones within wellbore 114 and/or to isolate a DASIM 200. It is noted that although some of the figures may exemplify a horizontal or vertical wellbore, the principles of the apparatuses, systems, and methods disclosed may be similarly applicable to horizontal wellbore configurations, conventional vertical wellbore configurations, and combinations thereof. Therefore, the horizontal or vertical nature of any figure is not to be construed as limiting the wellbore to any particular configuration.

Referring to FIG. 1, a wellbore servicing system 100 is illustrated. In the embodiment of FIG. 1, the wellbore servicing system 100 comprises the DASIM 200 incorporated with a tubular string 112 (e.g., a casing string, a production string, etc.) and positioned within the wellbore 114. Additionally, in an embodiment the wellbore servicing system 100 may further comprise an adjustable selector tool 300. In such an embodiment, the AST 300 may be positionable within the tubular string 112, for example, via a work string 301 (e.g., a slick line, a wire line, etc.) along the axial flow bore 126 of the work string 112. Also, in such an embodiment, the tubular string 112 may be positioned within the wellbore 114 such that the DASIM 200 is positioned proximate and/or substantially adjacent to one or more zones of the subterranean formation 102.

The AST 300 may be generally configured to adjust and/or configure the DASIM 200, for example, to improve the performance of one or more servicing operations, as will be disclosed herein. While this disclosure may refer to a DASIM 200 configured for a stimulation operation (e.g., a steam injection operation), as disclosed herein, a wellbore servicing tool incorporated with the wellbore servicing system may be configured for various additional or alternative operations and, as such, this disclosure should not be construed as limited to utilization in any particular wellbore servicing context unless so-designated. In an embodiment, the DASIM 200 may be adjustable and/or configurable, for example, being configured to adjust the flow rate of fluid communication from the DASIM 200 to the wellbore 114, the subterranean formation 102, and/or a zone thereof. In such an embodiment, the DASIM 200 may be configured for adjustment via the operation of a second wellbore servicing tool (e.g., an AST 300). Although the embodiment of FIG. 1 illustrates three DASIM 200 (e.g., being positioned substantially proximate or adjacent to a formation), one of skill in the art viewing this disclosure will appreciate that any suitable number of wellbore servicing tools may be similarly incorporated within a tubular string 112, for example, 1, 2, 4, 5, 6, 7, 8, 9, 10, etc. wellbore servicing tools.

In an embodiment, the DASIM 200 may be generally configured to provide a route of fluid communication between the axial flow bore 126 of the tubular string 112 and the exterior of the DASIM 200 (e.g., the wellbore 114), for example, to perform one or more wellbore servicing operations (e.g., a steam injection treatment). Additionally, the DASIM 200 is configured to transition between a plurality of configurations to provide an adjustable fluid flow rate.

Figure 2A:
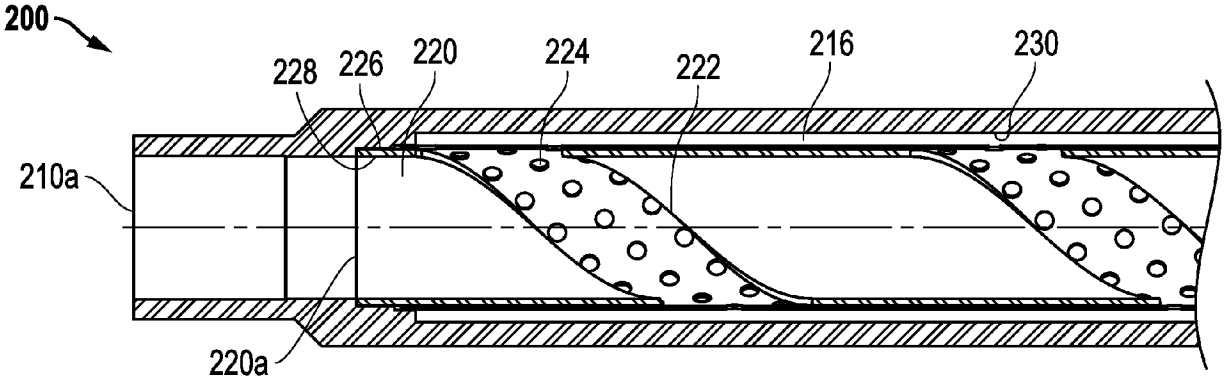
FIG. 2A-2B are cut-away views of successive axial sections of an embodiment of a downhole adjustable steam injection mandrel tool in a first configuration.
Figure 2B:
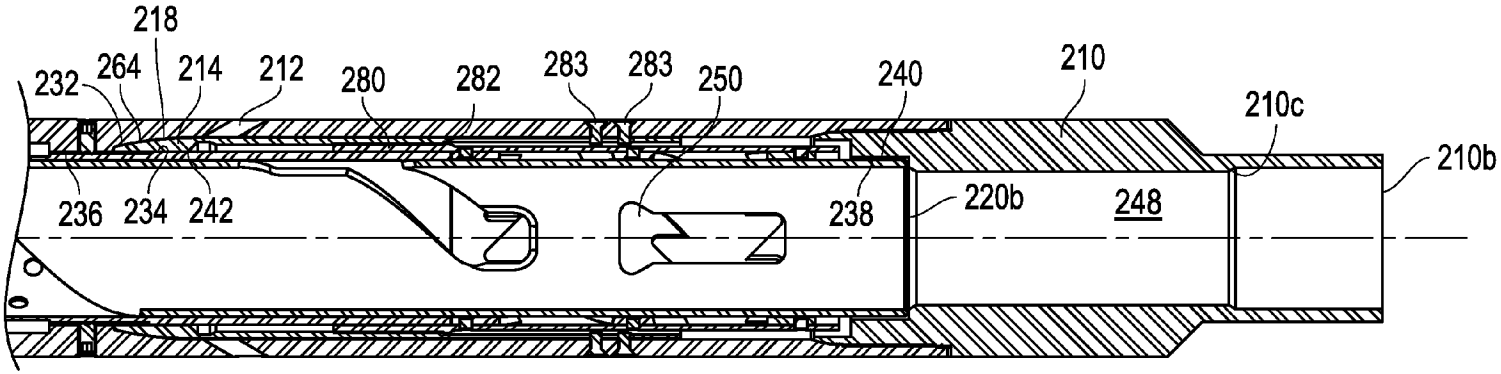

Referring to FIGS. 2A-2B, an embodiment of a DASIM 200 is illustrated in a first configuration. In an embodiment, when the DASIM 200 is in the first configuration, the DASIM 200 may be configured so as to disallow (e.g., substantially prevent) fluid communication between the interior of the DASIM 200 (e.g., an axial flow bore) and the exterior of the DASIM 200. In an embodiment, as is disclosed herein, the DASIM 200 may be configured to transition from the first configuration to a second configuration upon actuation (e.g., via the AST 300) of a ratchet mechanism 250 in a first direction, as will be disclosed herein.

Figure 3A:
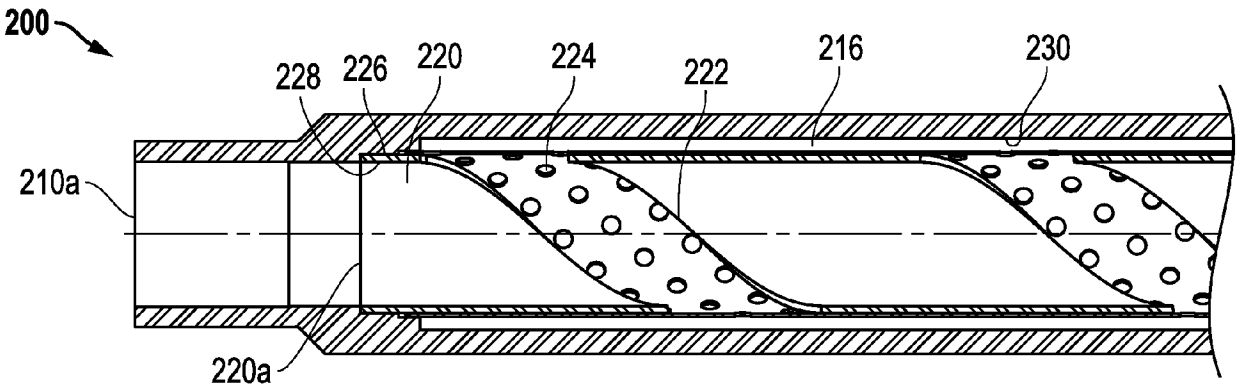
FIG. 3A-3B are cut-away views of successive axial sections of an embodiment of a downhole adjustable steam injection mandrel tool in a second configuration.
Figure 3B:
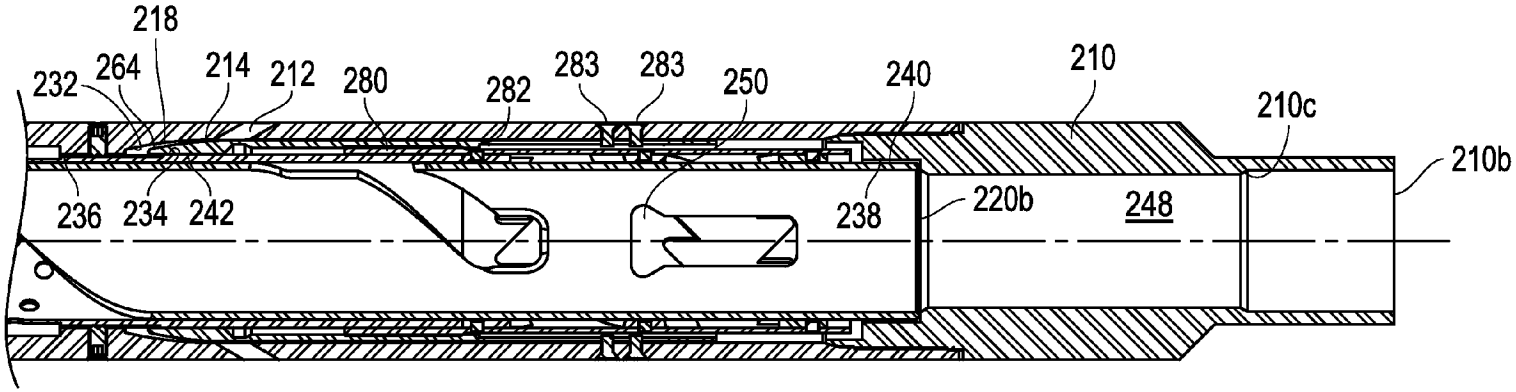

Referring to FIGS. 3A-3B, an embodiment of a DASIM 200 is illustrated in a second configuration. In an embodiment, when the DASIM 200 is in the second configuration, the DASIM 200 may be configured so as to at least partially allow fluid communication between the interior of the DASIM 200 (e.g., an axial flow bore) and the exterior of the DASIM 200. In an embodiment, as is disclosed herein, the DASIM 200 may be configured to transition between the second configuration and a third configuration upon further actuation (e.g., via the AST 300) of the ratchet mechanism 250 in the first direction, as will be disclosed herein. Additionally, the DASIM 200 may be configured to transition from the second configuration to the first configuration upon actuation (e.g., via the AST 300) of a ratchet mechanism 250 in a second direction.

Figure 4A:
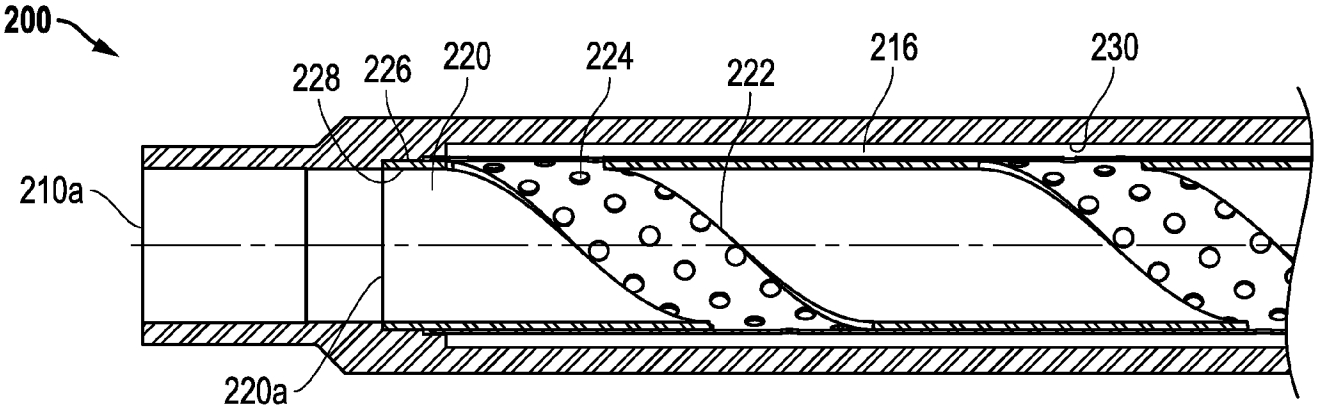
FIG. 4A-4B are cut-away views of successive axial sections of an embodiment of a downhole adjustable steam injection mandrel tool in a third configuration.
Figure 4B:
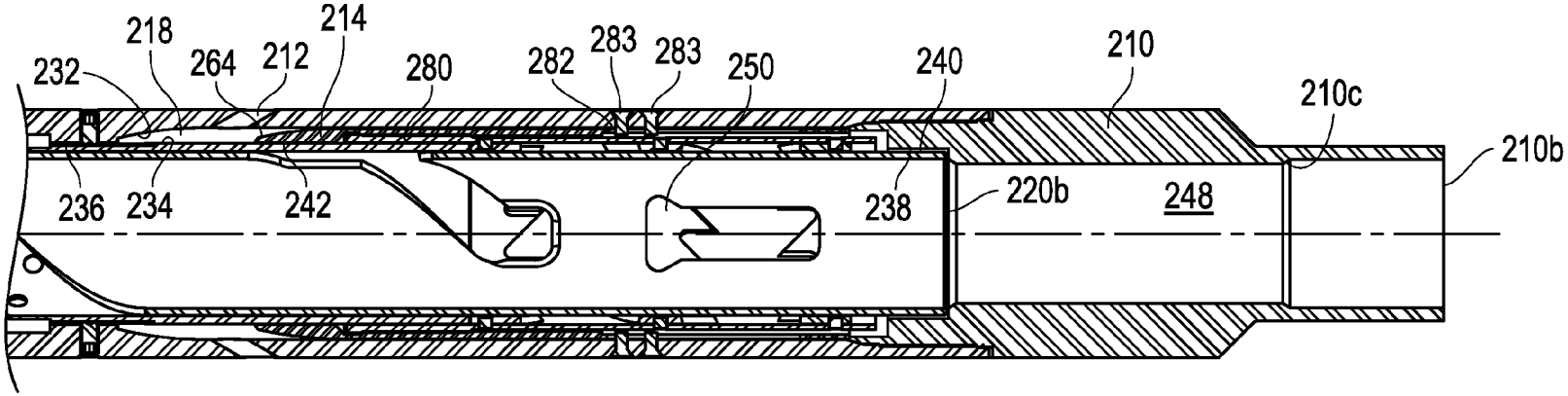

Referring to FIGS. 4A-4B, an embodiment of a DASIM 200 is illustrated in a third configuration. In an embodiment, when the DASIM 200 is in the third configuration, the DASIM 200 may be configured so as to allow fluid communication at a maximum flow rate between the interior of the DASIM 200 (e.g., an axial flow bore) and the exterior of the DASIM 200. In an embodiment, as is disclosed herein, the DASIM 200 may be configured to transition from the third configuration to the second configuration upon actuation (e.g., via the AST 300) of the ratchet mechanism 250 in the second direction, as will be disclosed herein.

Referring to FIGS. 2A-2B, 3A-3B, and 4A-4B, in an embodiment the DASIM 200 generally comprises a housing 210, an inner mandrel 220, a valve sleeve 214, and the ratchet mechanism 250. While an embodiment of the DASIM 200 is disclosed with respect to FIGS. 2A-2B, 3A-3B, and 4A-4B, one of ordinary skill in the art upon viewing this disclosure, will recognize suitable alternative configurations. As such, while embodiments, of a DASIM may be disclosed with reference to a given configuration (e.g., DASIM 200 as will be disclosed with respect to FIGS. 2A-2B, 3A-3B, and 4A-4B), this disclosure should not be construed as limited to such embodiments.

In an embodiment, the housing 210 may be characterized as a generally tubular body having a first terminal end 210*a* (e.g., an up-hole end) and a second terminal end 210*b* (e.g., a down-hole end), for example, as illustrated in FIGS. 2A-2B, 3A-3B, and 4A-4B. The housing 210 may be characterized as generally defining a longitudinal axial flow bore 248. In an embodiment, the housing 210 may be configured for connection to and/or incorporation within a tubular string (e.g., the tubular string 112 as shown in FIG. 1), for example, the housing 210 may comprise a suitable means of connection to the tubular string 112. For instance, the first terminal end 210*a* of the housing 210 may comprise internally and/or externally threaded surfaces as may be suitably employed in making a threaded connection to the tubular string 112. In an additional or alternative embodiment, the second terminal end 210*b* of the housing 210 may also comprise internally and/or externally threaded surfaces as may be suitably employed in making a threaded connection to the tubular string 112. Alternatively, a DASIM like DASIM 200 may be incorporated with a tubular string like tubular string 112 via any suitable connection, such as, for example, via one or more quick-connector type connections.

Suitable connections to a tubular string member will be known to those of ordinary skill in the art viewing this disclosure.

In an embodiment, the housing 210 may be configured to support one or more sleeves (e.g., the inner mandrel 220), as will be disclosed herein. For example, the housing 210 may comprise a first cylindrical bore surface 228 proximate to the first terminal end 210*a* (e.g., an uphole end), a second cylindrical bore surface 236, a third cylindrical bore surface 240 proximate to the second terminal end 210*b* (e.g., a downhole end), a fourth cylindrical bore surface 230 spanning between the first cylindrical bore surface 228 and the second cylindrical bore surface 236, and a fifth cylindrical bore surface spanning between the second cylindrical bore surface 236 and the third cylindrical bore surface 238. In an embodiment, the fourth cylindrical bore surface 230 and/or the fifth cylindrical bore surface 232 may be generally characterized as having a diameter greater than the diameter of the first cylindrical bore surface 228, the second cylindrical bore surface 236, and the third cylindrical bore surface 238.

Additionally, in an embodiment, the housing 210 comprises one or more ports 212 configured to provide a route of fluid communication between the axial flow bore 248 of the DASIM 200 and the exterior of the DASIM 200, when so-configured. For example, in the embodiments of FIGS. 2A-2B, 3A-3B, and 4A-4B, the housing 210 comprises the ports 212 which may be suitable sized (e.g., port diameter), for example, to control and/or allow a desired and/or predetermined fluid flow-rate. Additionally or alternatively, the ports 212 may further comprise a nozzle, a valve, a cover, a screen, a fluidic diode, any other suitable flow-rate and/or pressure altering component as would be appreciated by one of ordinary skill in the art upon viewing this disclosure, or combination thereof.

In an embodiment, the inner mandrel 220 may be characterized as a generally tubular body having a first mandrel terminal end 220*a* (e.g., an up-hole end) and a second mandrel terminal end 220*b* (e.g., a down-hole end), for example, as illustrated in FIGS. 2A-2B, 3A-3B, and 4A-4B. The inner mandrel 220 may be characterized as generally defining a longitudinal axial flow bore, for example, such that a fluid communicated via the axial flow bore 248 of the housing 210 will flow into and through the axial flow bore of the inner mandrel 220. In an embodiment, the inner mandrel 220 may comprise a first outer cylindrical surface 226 extending from the first mandrel terminal end 220*a* (e.g., an uphole end), a third outer cylindrical bore surface 240 extending from the second mandrel terminal end 220*b* (e.g., an down-hole end), and a second outer cylindrical bore surface 234 spanning between the first outer cylindrical surface 226 and the third outer cylindrical surface 240. In such an embodiment, the first outer cylindrical surface 226 and the fourth cylindrical bore surface 230 may form a first annular region 216, for example, spanning between the first cylindrical bore surface 228 and the second cylindrical bore surface 236. Additionally, the fifth cylindrical bore surface 232 and the second outer cylindrical bore surface 234 and/or the third outer cylindrical bore surface 240 may form a second annular region 218, for example, spanning between the second cylindrical bore surface 236 and the third cylindrical bore surface 238. In such an embodiment, the DASIM 200 may be configured such that a fluid (e.g., an aqueous fluid) may be communicated from the axial flow bore 248 to the first annular region 216 to the second annular region 218 and may exit the DASIM 200 via the ports 212. Additionally, the inner mandrel 220 may be configured for connection to and/or incorporation within the housing 210, for example, the inner mandrel 220 may comprise a suitable means of connection to the housing 210. For instance, the first outer cylindrical surface 226 of the inner mandrel 220 may comprise an at least partially threaded surface as may be suitably employed in making a threaded connection to an interior portion of the housing 210 (e.g., the first cylindrical bore surface 228). In an additional or alternative embodiment, the third cylindrical bore surface 240 of the inner mandrel may also comprise an at least partially externally threaded surface as may be suitably employed in making a threaded connection to an interior portion of the housing 210 (e.g., the third cylindrical bore surface 238).

In an embodiment, as illustrated in FIGS. 2A-2B, 3A-3B, and 4A-4B, the inner mandrel 220 comprises a helical slot, groove, pathway, or the like along the interior and/or exterior of the inner mandrel 220. For example, the helical slot 222 may be configured to provide a pathway or guide for one or more wellbore servicing tools (e.g., the AST 300), as will be disclosed herein. In such an embodiment, the helical slot 222 may form a rotating pathway between the first terminal mandrel end 220*a* and the second terminal mandrel end 220*b* about or greater than 360 degrees about the inner mandrel, for example, about 540 degrees, about 720 degrees, about 900 degrees, etc. For example, the helical slot 222 may form inclined planes (e.g., about 45 degree planes) along the inner mandrel 220. Additionally, at least a portion of the helical slot 222 may further comprise a ported cover 224 comprising a plurality of holes, perforations, ports, or the like. For example, the ported cover 224 may be configured to provide a route of fluid communication between the axial flow bore of the inner mandrel 220 and the exterior (e.g., the first annular region 216) of the inner mandrel 220, for example, a route of fluid communication for condensation formed during a wellbore servicing operation, as will be disclosed herein. For example, the DASIM 200 may be configured such that condensation and/or moisture formed along the inner mandrel 220 during a wellbore servicing operation (e.g., steam injection) may be reintroduced to the wellbore servicing operation to be utilized via the ported cover 224.

Additionally, the helical slot 222 may further comprise a decision path, a "Y" path, a branch, or the like. For example, a terminal end (e.g., a downhole end) of the helical slot 222 may comprise a decision path and may be configured to provide a plurality of pathways along the helical slot 222. In such an instance, the helical slot 222 may be configured to guide a wellbore servicing tool (e.g., the AST 300) along the any of the plurality of pathways, when so-configured. Additionally, in an embodiment, each of the pathways may be configured to allow and/or to engage a predetermined wellbore servicing tool and/or predetermined configuration of wellbore servicing tool, as will be disclosed herein.

In an embodiment, the valve sleeve 214 may be positionable and configureable to selectively allow, disallow, and/or partially disallow fluid communication from the DASIM 200 via the ports 212 and, thereby adjust the flow rate of the DASIM 200. In an embodiment, the valve sleeve 214 may generally comprise a cylindrical or tubular structure having a cylindrical sleeve bore 242 generally defining an axial flow bore extending there-through. The valve sleeve 214 may comprise a unitary structure (e.g., a single solid piece). In an alternative embodiment, the valve sleeve 214 may comprise two or more segments, for example, two or more segments coupled together via one or more threaded connections. Alternatively, the two or more segments may be joined via any suitable methods as would be appreciated by one of ordinary skill in the art upon viewing this disclosure.

In an embodiment, the valve sleeve 214 may be positionable and concentrically positioned within the housing 210 (e.g., within the second annular region 218), for example, via the ratchet mechanism 250, as will be disclosed. The valve sleeve 214 may be positionable (e.g., rotationally or slidably movable) with respect to the housing 210, for example, via the ratchet mechanism 250, as will be disclosed herein. In the embodiments of FIGS. 2A-2B, 3A-3B, and 4A-4B, the valve sleeve 214 may be slidably fit against at least a portion of the fifth cylindrical bore surface 232 of the housing 210 and at least a portion of the second outer cylindrical surface 234 of the inner mandrel 220. In an embodiment, one or more of the interfaces between the valve sleeve 214 and the housing 210 and/or the inner mandrel 220 may be fluid-tight and/or substantially fluid-tight. For example, the housing 210, the valve sleeve 214, and/or the inner mandrel 220 may comprise one or more suitable seals at such an interface, for example, for the purpose of prohibiting or restricting fluid movement via such an interface. Suitable seals include but are not limited to T-seals, an O-ring, a gasket, any other suitable seals as would be appreciated by one of ordinary skill in the art upon viewing this disclosure, or combinations thereof.

In such an embodiment, the valve sleeve 214 may be configured to transition from a first configuration to a second configuration and from the second configuration to a third configuration. Referring to the embodiment of FIGS. 2A-2B, when the DASIM 200 is in first configuration, the valve sleeve 214 is in the first configuration. When the valve sleeve 214 is in the first configuration, the valve sleeve 214 is configured to substantially cover or block the ports 212 of the DASIM 200 and thereby prohibit and/or substantially prohibit fluid communication from the DASIM 200 via the ports 212. Referring to the embodiment of FIGS. 3A-3B, when the DASIM 200 is in second configuration, the valve sleeve 214 is in the second configuration. When the valve sleeve 214 is in the second configuration, the valve sleeve 214 is configured to partially cover or block the ports 212 of the DASIM 200 and thereby partially prohibit fluid communication from the DASIM 200 via the ports 212. Referring to the embodiment of FIGS. 4A-4B, when the DASIM 200 is in third configuration, the valve sleeve 214 is in the third configuration. When the valve sleeve 214 is in the third configuration, the valve sleeve 214 is configured to not cover or block the ports 212 of the DASIM 200 and thereby substantially allows fluid communication from the DASIM 200 via the ports 212.

In an additional or alternative embodiment, a flow path formed between the fifth cylindrical bore surface 232 and a valve sleeve contact surface 264 may act as a fluid choke or restriction. For example, in the embodiments of FIGS. 2A-2B, the flow path may be sealed (e.g., via the fluid choke) to substantially prevent fluid flow. Additionally, the fluid choke may be widened to allow a greater fluid flow.

In an embodiment, the ratchet mechanism 250 may be configured to adjust the fluid flow rate of the DASIM 200, for example, via positioning or configuring the valve sleeve 214, as will be disclosed herein. In the embodiment of 2A-2B, 3A-3B, and 4A-4B, the ratchet mechanism 250 may be disposed within the inner mandrel 220 of the DASIM 200, for example, within a down-hole portion of the DASIM 200. Referring to the embodiment of FIGS. 5 and 6, the ratchet mechanism 250 comprises a plurality of continuous profiles. In an embodiment, the continuous profiles may generally define a continuous edge or profile (e.g., a continuous profile comprising a plurality of ratchet teeth) of one more portions of the ratchet mechanism 250, as will be disclosed herein. For example, the ratchet mechanism 250 comprises a first continuous profile 258 along an edge (e.g., a downhole facing edge) of a first ratchet portion 252, a second continuous profile 260 along an edge (e.g., an uphole facing edge) of a second ratchet portion 254, a third continuous profile 262 along an edge (e.g., a downhole facing edge) of the second ratchet portion 254, and a fourth continuous profile 264 along an edge (e.g., an uphole facing edge) of a third ratchet portion 256. Additionally, the first continuous profile 258 and the second continuous profile 260 may form a first continuous slot 270 (e.g., continuous J-slots, control grooves, indexing slots, etc.) and the third continuous profile 262 and the fourth continuous profile 264 may form a second continuous slot 272. As used herein, a continuous slot refers to a slot extending entirely about (e.g., 360 degrees) the circumference of the ratchet mechanism 250. A continuous profile refers to a design in which several lug positions are possible corresponding to a rotational position of the ratchet mechanism 250.

Figure 5:
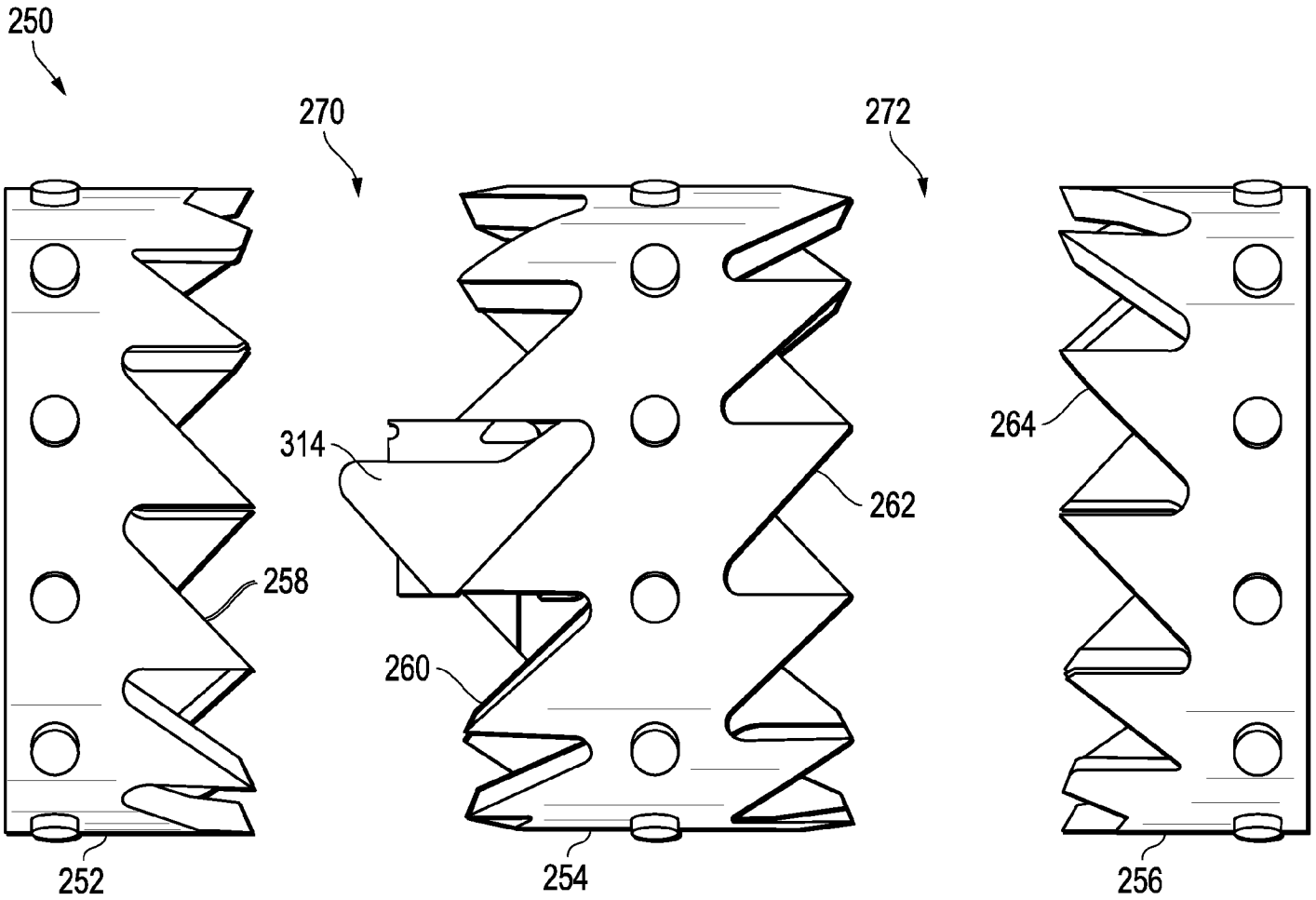
FIG. 5 is partial view of an embodiment of an adjustable selector tool and a ratchet mechanism.
Figure 6:
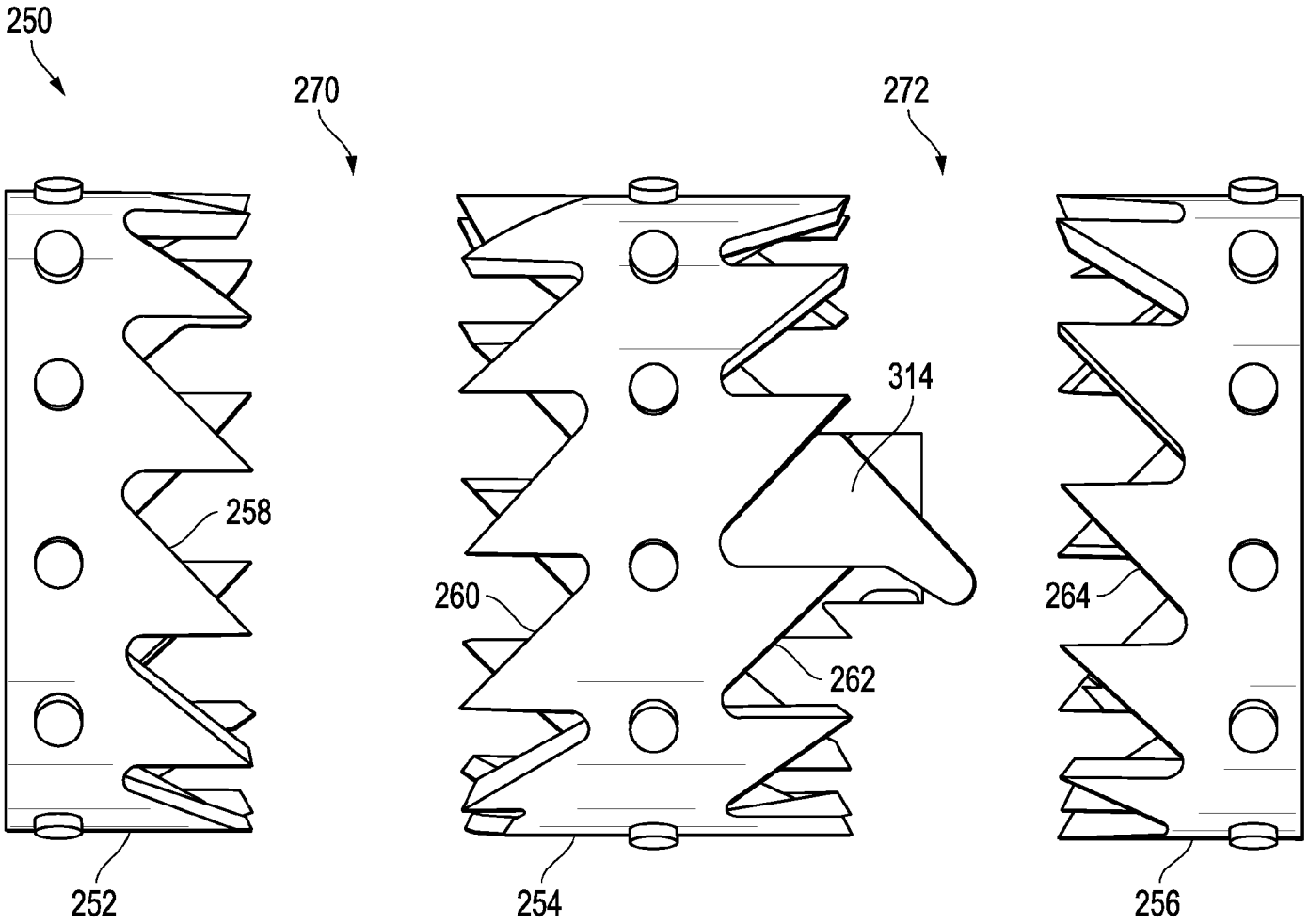
FIG. 6 is a partial view of another embodiment of an adjustable selector tool and a ratchet mechanism.

Additionally, the ratchet mechanism 250 may be configured to engage a lug (e.g., a selector key 314, as will be disclosed), for example, via the first continuous profile 258, the second continuous profile 260, the third continuous profile 262, and/or the fourth continuous profile 264. In an embodiment, the ratchet mechanism 250 is configured to rotate in response to a force applied by the engagement between the lug (e.g., the selector key 314) and the ratchet mechanism 250. For example, the ratchet mechanism 250 may be configured to rotate due to the angled edge interface between the selector key 314 and the first continuous profile 258, the second continuous profile 260, the third continuous profile 262, and/or the fourth continuous profile 264. Additionally, the ratchet mechanism 250 may be configured such that a complete cycle (e.g., raising and lowering, or lowering and raising) of the selector key 314 results in partial or complete rotation of the ratchet mechanism 250. In an embodiment, the ratchet mechanism 250 may be configured such that a complete cycle of a selector key 314 between the first continuous profile 258 and the second continuous profile 260 (e.g., within the first continuous slot 270) causes the ratchet mechanism 250 to rotate in a first direction (e.g., clock-wise or counter-clockwise), as illustrated in FIG. 5. Additionally, the ratchet mechanism 250 may be configured such that a complete cycle of a selector key 314 between the third continuous profile 262 and the fourth continuous profile 256 (e.g., within the second continuous slot 272) causes the ratchet mechanism 250 to rotate in a second direction (e.g., clock-wise or counter-clockwise), as illustrated in FIG. 6. In an embodiment, the ratchet mechanism 250 may be configured to rotate in the first direction or the second direction until the DASIM 200 transitions to a desired configuration (e.g., to the first configuration or the third configuration, or any point in between). Additionally, the number of teeth of the continuous slots may determine the amount of rotation provided by each cycling the ratchet mechanism 250. As such, the amount of rotation provided by each cycling the ratchet mechanism 250 may allow the amount of travel of the valve sleeve 214 to be controlled.

In an embodiment, the ratchet mechanism 250 is coupled to and/or joined with the valve sleeve 214 and is configured to position and/or move the valve sleeve 214 longitudinally with respect to the housing 210. For example, in an embodiment, the ratchet mechanism 250 and the valve sleeve 214 may be joined or coupled via a threaded connection or interface (e.g., threads 280). In such an embodiment, the ratchet mechanism 250 may be configured to rotate (e.g., clock-wise or counter clock-wise) the threaded interface about the longitudinal axis of the axial flow bore. Additionally, the rotational movement of the ratchet mechanism 250 (e.g., the threaded interface) may induce a longitudinal movement or translation of the valve sleeve 214 with respect to the housing 210. For example, the thread pitch of the threaded interface may determine the amount of rotation provided by each cycling the ratchet mechanism 250 and thereby controls the amount of travel of the valve sleeve 214. As such, the resolution of linear travel may be determined by the number of teeth along one or more continuous profiles (e.g., the first continuous profile 258, the second continuous profile 260, the third continuous profile 262, and/or the fourth continuous profile 264) and/or the thread pitch of the threads 280.

In an embodiment, the ratchet mechanism 250 may be configured such that the full range of rotation of the ratchet mechanism 250 provides a predetermined linear travel of the valve sleeve 214, for example, about 2 inches (in), about 2.5 in, about 2.815 in, about 6 in, about 1 foot (ft), or any other suitable travel distance as would be appreciated by one of ordinary skill in the art upon viewing this disclosure. As such, the total travel may be limited by the length of a slot 282 and one or more pins 283. Additionally, the ratchet mechanism 250 may be configured such that each partial revolution provides partial linear movement or travel, for example, a $1/12^{th}$ revolution may provide a linear travel of about 0.0833 in. In an alternative embodiment, the ratchet mechanism 250 and the valve sleeve 214 may be joined and/or coupled via any other suitable method as would be appreciated by one of ordinary skill in the art upon viewing this disclosure.

In an embodiment, the AST 300 may be generally configured to selectively actuate or transition the DASIM 200 between the first configuration, the second configuration, and the third configuration, or any point in between. Additionally, the AST 300 is configured to transition between a plurality of configurations to engage or disengage a well tools (e.g., a DASIM 200), as will be disclosed herein.

Referring to FIGS. 7-10, in an embodiment the AST 300 may have a longitudinal axis 500 and may comprise a first AST terminal portion 300*a* (e.g., an uphole end portion) and a second AST terminal portion 300*b* (e.g., a downhole end portion). Additionally, the AST 300 may generally comprise a first housing portion 320, a second housing portion 312, a third housing portion 304, a selector key 314, and a sliding catch 324. While an embodiment of the AST 300 is disclosed with respect to FIGS. 7-10, one of ordinary skill in the art upon viewing this disclosure will recognize suitable alternative configurations. As such, while embodiments, of a AST may be disclosed with reference to a given configuration (e.g., AST 300 as will be disclosed with respect to FIGS. 7-10), this disclosure should not be construed as limited to such embodiments.

In an embodiment, the second housing portion 312 may generally be a cylindrical and/or tubular structure. In the embodiment of FIGS. 7-10, the second housing portion 312 may comprise a first cylindrical bore surface 312*a*, a second cylindrical bore surface 312*b*, a first cylindrical surface 312*c*, a second cylindrical surface 312*d*, and a third cylindrical surface 312*e*. In an embodiment, the first cylindrical surface 312*c* may be generally characterized as having a diameter greater than the second cylindrical surface 312*d* and the third cylindrical surface 312*e*. Additionally, in such an embodiment, the second cylindrical surface 312*d* may be generally characterized as having a diameter greater than the third cylindrical surface 312*e*. In an embodiment, the first cylindrical bore surface 312*a* may be generally characterized as having a diameter greater than the second cylindrical bore surface 312*b*. In the embodiments of FIG. 7-10, the second housing portion 312 is configured to receive and/or house at least a portion of the first housing portion 302. For example, the first cylindrical bore surface 312*a* and the second cylindrical bore surface 312*b* may be configured and/or sized to house at least a portion of the first housing portion 302 (e.g., a second cylindrical surface 302*b* and a third cylindrical surface 302*c* of the first housing portion 302, respectively, when so-configured). Additionally, the second housing portion 312 may comprise one or more locking pin bores 308 (e.g., a hole, a bore, a slot, a groove, etc.). In such an embodiment, the locking pin bore 308 may be configured to receive and retain a locking pin, for example, a locking pin 310, as will be disclosed.

Figure 7:
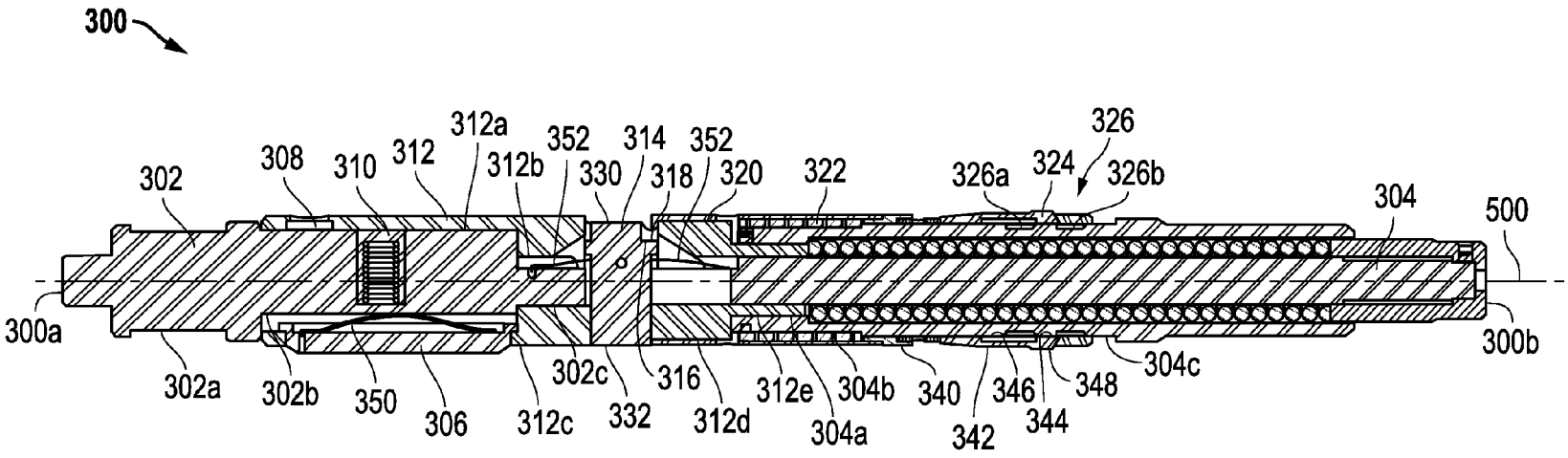
FIG. 7 is a cutaway view of an embodiment of an adjustment selector tool in a first configuration.
Figure 8:
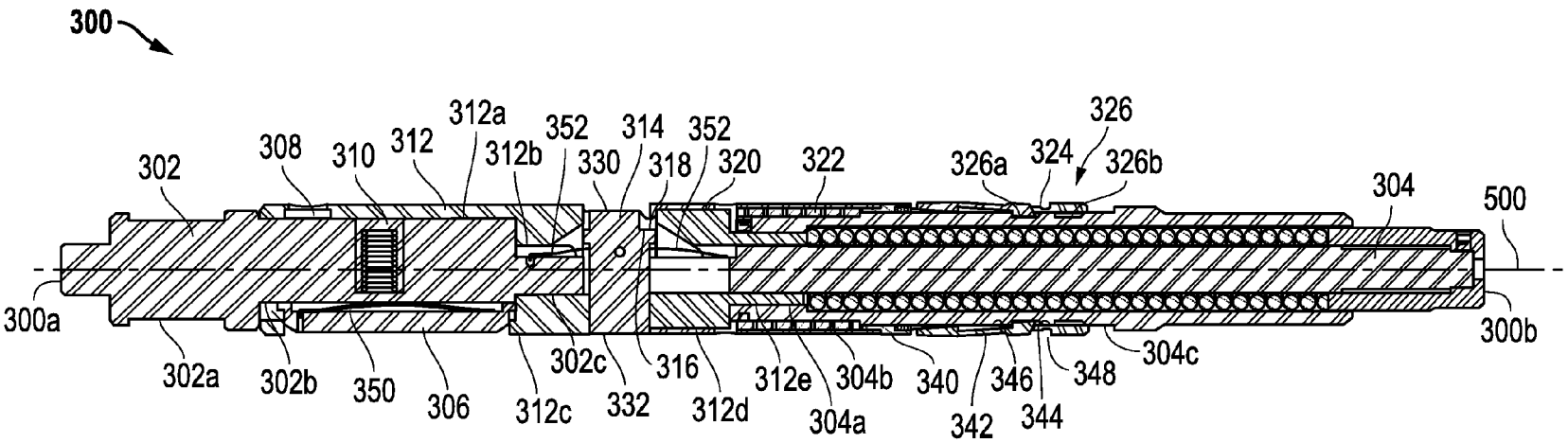
FIG. 8 is a cutaway view of an embodiment of an adjustment selector tool in a second configuration.
Figure 9:
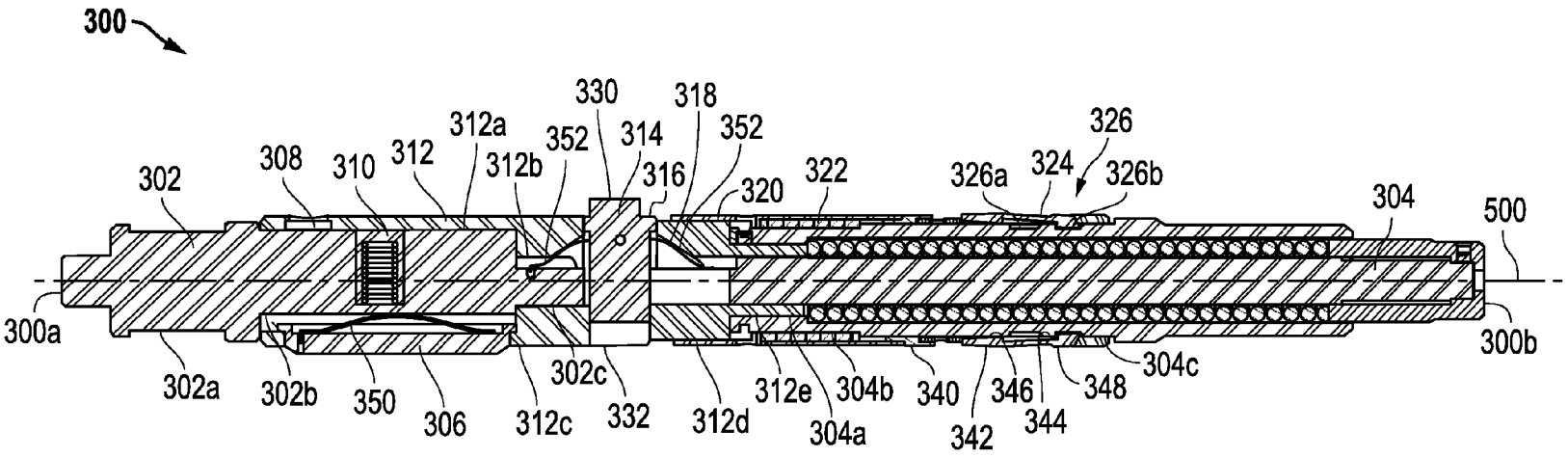
FIG. 9 is a cutaway view of an embodiment of an adjustment selector tool in a third configuration.
Figure 10:
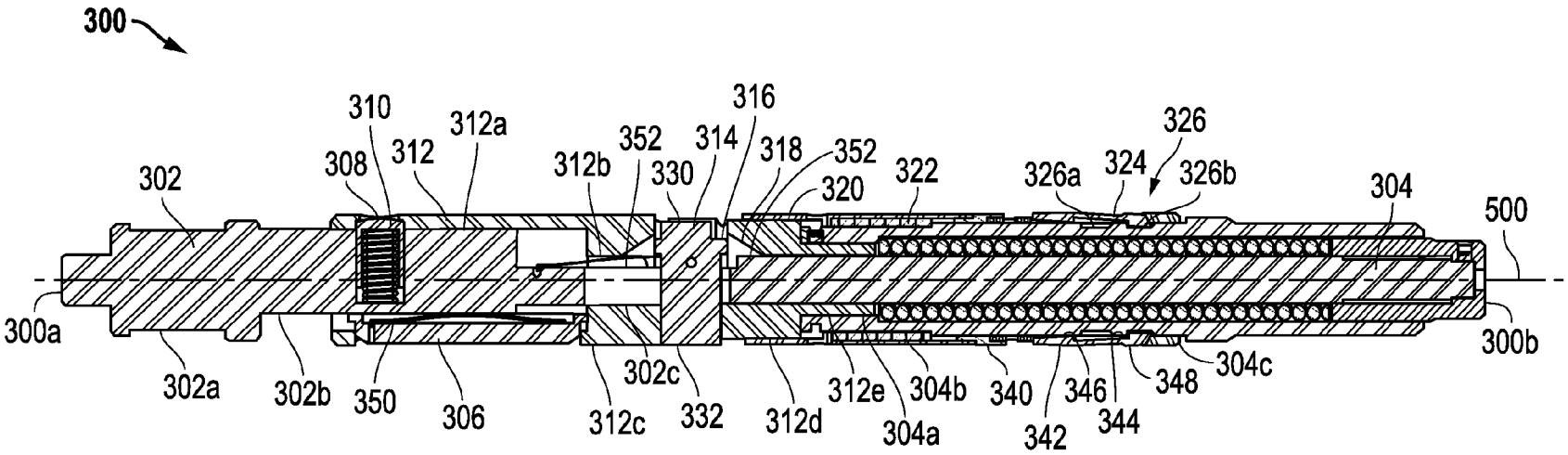
FIG. 10 is a cutaway view of an embodiment of an adjustment selector tool in a fourth configuration.

In the embodiment of FIGS. 7-10, the second housing portion 312 may be configured to house or retain a floating catch 306. For example, the second housing portion 312 may be configured to house the floating catch 306 within a recess or opening within the first cylindrical bore surface 312*a*. In such an embodiment, the floating catch 306 may transitionable between an extended position and a retracted position. In the embodiment of FIGS. 7 & 9, when the floating catch 306 is in the extended position, the floating catch 306 may be configured to extend beyond the outer profile of the first cylindrical surface 312*c*. In the embodiment of FIGS. 9 & 10, when the floating catch 306 is in the retracted position, the floating catch 306 may be configured to remain within the outer profile of the first cylindrical surface 312*c*. Additionally, in the embodiments of FIGS. 7-10, the floating catch 306 may be configured to be normally in the extended position (e.g., during run-in), for example, the floating catch 306 may comprise a leaf spring 350 configured to exert a sufficient force to retain floating catch 306 in the extended position.

Additionally, in an embodiment of FIGS. 7-10, the second housing portion 312 may be configured to house or retain the selector key 314. For example, the second housing portion 312 may be configured to house the selector key 314 within a recess or opening within the first cylindrical bore surface 312*a*. In such an embodiment, the selector key 314 comprises an engagement portion 330 and a body portion 332. In an embodiment, the engagement portion 330 may be configured to engage and/or interface with a well tool (e.g., a DASIM 200). For example, in an embodiment, the engagement portion 330 may be configured to engage and/or actuate a ratcheting mechanism 250 of a DASIM 200. Additionally, the engagement portion 330 may comprise a unique profile or key and may be configured to only engage suitable mating well tools (e.g., a DASIM) and/or mating portions of a well tool (e.g., a continuous profile of a ratcheting mechanism). In an embodiment, the body portion 332 may comprise a retaining lip 316. As such, the retaining lip 316 may be configured to provide a mechanism for retaining the selector key 314 in one or more positions, for example, a retracted position, as will be disclosed herein.

In an embodiment, the selector key 314 may be transitionable between an extended position and a retracted position. In the embodiment of FIG. 9, when the selector key 314 is in the extended position, the selector key 314 may be configured to extend beyond the outer profile of the first cylindrical surface 312*c* of the second housing portion 312 and may be configured to engage a well tool (e.g., the ratcheting mechanism 250 of a DASIM 200). In the embodiment of FIGS. 7-8 & 10, when the selector key 314 is in the retracted position, the selector key 314 may be configured to remain within the outer profile of the first cylindrical surface 312*c* of the second housing portion 312 and may be configured to not engage a well tool. Additionally, in the embodiments of FIGS. 7-10, the selector key 314 may comprise one or more leaf springs 352 that may to exert a force to bias the selector key 314 towards the extended position, through an engagement between the second body portion 312 and the leaf spring 352 may retain the selector key 314 in the retracted position.

In an embodiment, the first housing portion 302 may generally be a cylindrical and/or tubular structure and may be positioned on the first AST terminal portion 300*a* side of the AST 300 and/or the second portion housing 312. In the embodiment of FIGS. 7-10, the first housing portion 302 may comprise a first cylindrical surface 302*a*, a second cylindrical surface 302*b*, and a third cylindrical surface 302*c*. In such an embodiment, the first cylindrical surface 302*a* may be generally characterized as having a diameter greater than the second cylindrical surface 302*b* and the third cylindrical surface 302*c*. Additionally, the second cylindrical surface 302*b* may be generally characterized as having a diameter greater than the third cylindrical surface 320*c*.

The first housing portion 302 may be configured to engage and/or couple to a work string (e.g., a slick line, a wire line, etc.). For example, the first cylindrical surface 302*a* of the first housing portion 302 may comprise internally and/or externally threaded surfaces as may be suitably employed in making a threaded connection to the work string (e.g., work string 301 as shown in FIG. 1). Alternatively, an AST like AST 300 may be incorporated with a work string by any suitable connection, such as, for example, via one or more quick-connector type connections. Suitable connections to a work string member will be known to those of ordinary skill in the art viewing this disclosure.

Additionally, in the embodiments of FIGS. 7-10, the first housing portion 302 may comprise a locking pin 310. For example, the first housing portion 302 may comprise the locking pin 310 within a recess within the second cylindrical surface 302*b*. In such an embodiment, the locking pin 310 may be transitionable between an extended position and a retracted position. In the embodiment of FIG. 10, when the locking pin 310 is in the extended position, the locking pin 310 may be configured to extended beyond the outer profile of the second cylindrical surface 302*b* and may engage a mating hole, slot, recess, groove, or the like, for example, the locking pin bore 308. In the embodiment of FIGS. 7-9, when the locking pin 310 is in the retracted position, the locking pin 310 may be configured to remain within the outer profile of the second cylindrical surface 302*b* to not engage a mating bore, hole, slot, recess, groove, or the like. Additionally, in the embodiments of FIGS. 7-10, the locking pin 310 may be configured to be biased towards the extended position, for example, the locking pin 310 may comprise a spring configured to exert a sufficient force to bias the locking pin 310 towards the extended position.

Additionally, the first housing portion 302 may be coupled to the selector key 314 of the second housing portion 312. For example, in the embodiment of FIGS. 7-10, the third cylindrical surface 302*c* of the first housing portion 302 may be coupled to the selector key 314 (e.g., via a leaf spring 352) and may be configured to apply a force onto the selector key 314 sufficient to transition the selector key 314 from the extended position to the retracted position, as will be disclosed herein.

In the embodiment of FIGS. 7-10, the first housing portion 302 may be configured to transition from a first position to a second position with respect to the second housing portion 312. In the embodiment of FIGS. 7-9, the first housing portion 302 is in the first position with respect to the second housing portion 312. As such, when the first housing portion 302 is in the first position with respect to the second housing portion 312, the locking pin 310 may be retain in the retracted position and the first housing portion 302 may not be configured to apply a significant force onto the selector key 314. In the embodiment of FIG. 10, the first housing portion 302 is in the second position with respect to the second housing portion 312. As such, when the first housing portion 302 is in the second position with respect to the second housing portion 312, the locking pin 310 may be in the extended position and the first housing portion 302 may be configured to apply a sufficient force to retain the selector key 314 in the retracted position (e.g., via a lateral tension force of the leaf spring 352 coupled between the first housing portion 302 and the selector key 314).

In an embodiment, the third housing portion 304 may generally be a cylindrical and/or tubular structure. In the embodiment of FIGS. 7-10, the third housing portion 304 may comprise a cylindrical bore surface 304*a*, a first cylindrical surface 304*b* and a second cylindrical surface 304*c*. In an embodiment, the first cylindrical surface 304*b* may be generally characterized as having a diameter less than the second cylindrical surface 304*c*. Additionally, in such an embodiment, the third housing portion 304 is configured to receive and/or house at least a portion of the second housing portion 312. For example, the cylindrical bore surface 304*a* of the third housing portion 304 may be configured and/or sized to house the third cylindrical surface 312*e* of the second housing portion 312.

Additionally, in such an embodiment, the second cylindrical surface 304*c* may comprise a plurality of catch recesses 326 (e.g., grooves, notches, slots, recesses, etc.), particularly, a first catch recess 326*a* and a second catch recess 326*b*. In an embodiment, the catch recesses 326 may be configured to engage and/or retain a catch, for example, a sliding catch, as will be disclosed herein. In an embodiment, the catch recesses 326 may be configured to restrict and/or prohibit the movement of a sliding catch in a first direction (e.g., in a direction towards the first AST terminal portion 300*a*) and may allow movement of a sliding catch in a second direction (e.g., in a direction towards the second AST terminal portion 300*b*).

In the embodiment of FIGS. 7-10, the AST 300 further comprises a sliding catch 324. In an embodiment, the sliding catch 324 may generally be a cylindrical and/or tubular structure and may be disposed about the third housing portion 304 (e.g., the second cylindrical surface 304*c*). In such an embodiment, the sliding catch 324 comprises a cylindrical bore surface 346 and a cylindrical surface 344. In an embodiment, the sliding catch 324 comprises one or more catches 344 (e.g., a hook, a lip, a grasp, etc.) along the cylindrical bore surface 346 and is configured engage one or more catch recesses (e.g., catch recesses 326), when so-configured, as will be disclosed herein. Additionally, in such an embodiment, the cylindrical surface 344 may comprise a contact lip 348. In the embodiment of FIG. 7-10, the sliding catch 324 may be coupled with the spring, for example, via an up-hole facing contact surface 340, as will be disclosed herein.

In the embodiment of FIGS. 7-10, the sliding catch 324 may be configured to transition from a first position to a second position with respect to the third housing portion 304 and from the second position to a third position with respect to the third housing portion 304. In the embodiment of FIG. 7, when the sliding catch 324 is in the first position with respect to the third housing portion 304, the sliding catch 324 may not be configured to engage the first catch recess 326*a* or the second catch recess 326*b*. In the embodiment of FIG. 8, when the sliding catch 324 is in the second position with respect to the third housing portion 304, the sliding catch 324 may be configured to engage the first catch recess 326*a*. In the embodiment of FIGS. 9 & 10, when the sliding catch 324 is in the third position with respect to the third housing portion 304, the sliding catch 324 may be configured to engage the second catch recess 326*b*.

In an embodiment, the sliding catch 324 may be configured to transition and/or to be positioned upon experiencing an application of force onto the sliding catch 324 (e.g., the contact lip 348) along the longitudinal axis 500 (e.g., in an up-hole direction or a down-hole direction). For example, upon experiencing an application of force onto the contact lip 348 in the up-hole direction, the sliding catch 324 may be configured to from the first position to the second position with respect to the third housing portion 304. Additionally, upon experiencing an application of force onto the contact lip 348 in the down-hole direction, the sliding catch 324 may be configured to from the second position to the third position with respect to the third housing portion 304.

In an embodiment, the sliding collar 320 may generally be a cylindrical and/or tubular structure and may be disposed about at least a portion of the second housing portion 312 (e.g., the second cylindrical surface 312*d* and/or the third cylindrical surface 312*e*), the third housing portion 304 (e.g., the first cylindrical surface 304*b* and/or the second cylindrical surface 304*c*), and/or the sliding catch 324 (e.g., the cylindrical surface 344).

In the embodiment of FIGS. 7-10, the sliding collar 320 comprises a retaining lip catch 318. In such an embodiment, the retaining lip catch 318 is configured to engage and/or retain the selector key 314. For example, in the embodiments of FIGS. 7 & 8, the retaining lip catch 318 is configured to engage the retaining lip 316 and, thereby retain the selector key 314 in the retracted position, when so-configured, as will be disclosed herein.

In the embodiment of FIGS. 7-10, the sliding collar 320 is configured to transition from a first position to a second position with respect to the third housing portion 304. In the embodiment of FIGS. 7 & 8, when the sliding collar 320 is in the first position, the retaining lip catch 318 of the sliding collar 320 is configured to retain the selector key 314 in the retracted position via the retaining lip 316. In the embodiment of FIGS. 9 & 10, when the sliding collar 320 is in the second position, the retaining lip catch 318 of the sliding collar 320 is configured to not retain (e.g., no longer) the selector key 314 in the retracted position via the retaining lip 316.

In an embodiment, the AST 300 may comprise a spring 322 disposed within an annular space formed between the sliding collar 320 and the third housing portion 304 (e.g., the first cylindrical surface 304*b*). As such, the spring 322 may be configured to apply a force onto and/or to position the sliding collar 320 via the up-hole facing contact surface of the sliding catch 324, as will be disclosed herein. For example, in an embodiment, the spring 322 may be configured to apply a force onto sliding collar 320 in the direction of the second position with respect to the third housing portion 304 in response to at least a lower threshold of force applied by the movement of a sliding catch 324 in the direction of the second AST terminal portion 300*b* (e.g., a down-hole direction) and, thereby transition the sliding collar 320 from the first position to the second position with respect to the third housing portion 304.

Referring to FIG. 7, an embodiment of an AST 300 is illustrated in a first configuration. In an embodiment, when the AST 300 is in the first configuration, the AST 300 may be configured such that, the first housing portion 302 is in the first position with respect to the second housing portion 312, the locking pin 310 is in the retracted position, the floating catch 306 is in the extended position, the selector key 314 is in the retracted position, the sliding collar 320 is in the first position with respect to the third housing portion 304, and the sliding catch 324 is in the first position with respect to the third housing portion 304.

Referring to FIG. 8, an embodiment of an AST 300 is illustrated in a second configuration. In an embodiment, when the AST 300 is in the second configuration, the AST 300 may be configured in a "run-in" configuration such that, the first housing portion 302 is in the first position with respect to the second housing portion 312, the locking pin 310 is in the retracted position, the floating catch 306 is in the retracted position, the selector key 314 is in the retracted position, the sliding collar 320 is in the first position with respect to the third housing portion 304, and the sliding catch 324 is in the second position with respect to the third housing portion 304.

Referring to FIG. 9, an embodiment of an AST 300 is illustrated in a third configuration. In an embodiment, when the AST 300 is in the third configuration, the AST 300 may be configured such that, the first housing portion 302 is in the first position with respect to the second housing portion 312, the locking pin 310 is in the retracted position, the floating catch 306 is in the extended position, the selector key 314 is in the extended position, the sliding collar 320 is in the second position with respect to the third housing portion 304, and the sliding catch 324 is in the third position with respect to the third housing portion 304.

Referring to FIG. 10, an embodiment of an AST 300 is illustrated in a fourth configuration. In an embodiment, when the AST 300 is in the fourth configuration, the AST 300 may be configured such that, the first housing portion 302 is in the second position with respect to the second housing portion 312, the locking pin 310 is in the extended position, the floating catch 306 is in the retracted position, the selector key 314 is in the retracted position, the sliding collar 320 is in the second position with respect to the third housing portion 304, and the sliding catch 324 is in the third position with respect to the third housing portion 304.

Figure 11:
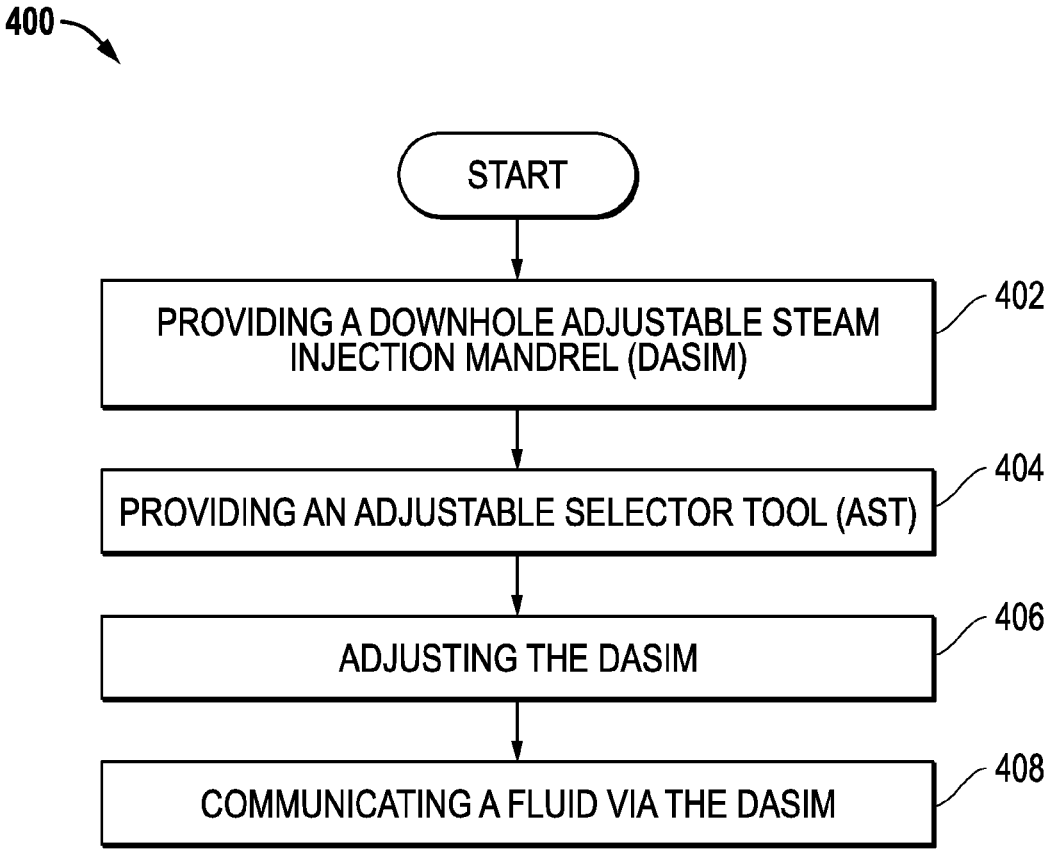
FIG. 11 is a flowchart of an embodiment of a wellbore servicing steam injection method.

In an embodiment, a wellbore servicing method utilizing a DASIM and/or a system comprising a DASIM is disclosed herein. In an embodiment, as illustrated in FIG. 11, the wellbore servicing method 400 may generally comprise the steps of providing a DASIM (e.g., a DASIM 200) 402, providing an AST (e.g., an AST 300) 404, adjusting the DASIM tool 406, and communicating a fluid via the DASIM 408.

Returning to FIG. 1, when providing a DASIM 402, one or more DASIMs, such as DASIM 200, may be provided and each DASIM 200 may be preconfigured to provide a desired fluid flow rate. In an embodiment, each DASIM 200 may be adjusted at the surface prior to integration with a tubular string 112 and/or prior to installation within a wellbore 114. For example, one or more DASIMs 200 may be adjusted to the first configuration, the second configuration, and/or the third configuration. In an embodiment, the one or more DASIMs 200 may be incorporated with the tubular string 112 and may be disposed and/or positioned to a desired depth within the wellbore 114. Additionally, providing the DASIM 402, may comprise isolating one or more adjacent zones and/or securing the tubular string 112 (e.g., within the wellbore 114) at a given or desired depth within the wellbore 114. For example, one or more packers 124 may be employed to couple and/or secure the tubular string 112 within the wellbore 114 and/or to isolate one or more DASIMs 200.

In an embodiment, when providing an AST 404, an AST, such as AST 300, may be provided in the first configuration. In such an embodiment, the AST 300 may comprise the required selector key 314 for a given operation. For example, the AST 300 may comprise an appropriate selector key 314 to actuate (e.g., to open or to close) a DASIM 200. In such an embodiment, the AST 300 may be coupled work a work string 301 and may be introduced to and/or conveyed downwardly (e.g., down-hole) through the axial flow bore 126 of the tubular string 112.

In an embodiment, adjusting the DASIM 406, may comprise the steps of transitioning the AST 300 from the first configuration to the second configuration, transitioning the AST 300 from the second configuration to the third configuration, actuating the DASIM 200, and transitioning the AST 300 from the third configuration to the fourth configuration.

In an embodiment, as the AST 300 is conveyed downward through the axial flow bore 126 of the tubular string 112, one or more surfaces of the AST 300 may engage the interior surface of the tubular string 112 and thereby transition the AST 300 from the first configuration to the second configuration. For example, the floating catch 306 may engage the interior surface of the tubular string 112 and may transition from the expanded position to the retracted position. Additionally, the sliding catch 324 (e.g., the contact lip 348) may engage the interior surface of the tubular string 112 and may transition from the first position to the second position with respect to the third housing portion 304.

In an embodiment, the AST 300 may be conveyed to a depth below (e.g., below the second terminal end 210*b* of the DASIM 200) the desired DASIM 200 to be adjusted and/or actuated. Following reaching a depth below the desired DASIM 200 to be actuated, the AST 300 may then be conveyed (e.g., pulled) in an upward (e.g., up-hole) direction. When the AST 300 is conveyed in an upward direction, one or more surfaces of the AST 300 may engage the interior surface of the tubular string 112 and thereby transition the AST 300 from the second configuration to the third configuration. For example, the sliding catch 324 (e.g., the contact lip 348) may engage the interior surface (e.g., a downward facing contact surface 210*c*) of the tubular string 112 and may transition from the second position to the third position with respect to the third housing portion 304. Additionally, transitioning the sliding catch 324 from the second position to the third position with respect to the third housing portion 304 and may apply a force onto the sliding collar 320 (e.g., via the spring 322) in the direction of the second position with respect to third housing portion 304 and thereby transition the sliding collar 320 from the first position to the second position with respect to the third housing portion 304. Further, transitioning the sliding collar 320 from the first position to the second position with respect to the third housing portion 304 may configure the retaining catch lip 318 of the sliding collar 320 to no longer retain the selector key 314 and thereby releases the selector key 314 and transitions the selector key 314 from the retracted position to the expanded position.

Figure 12:
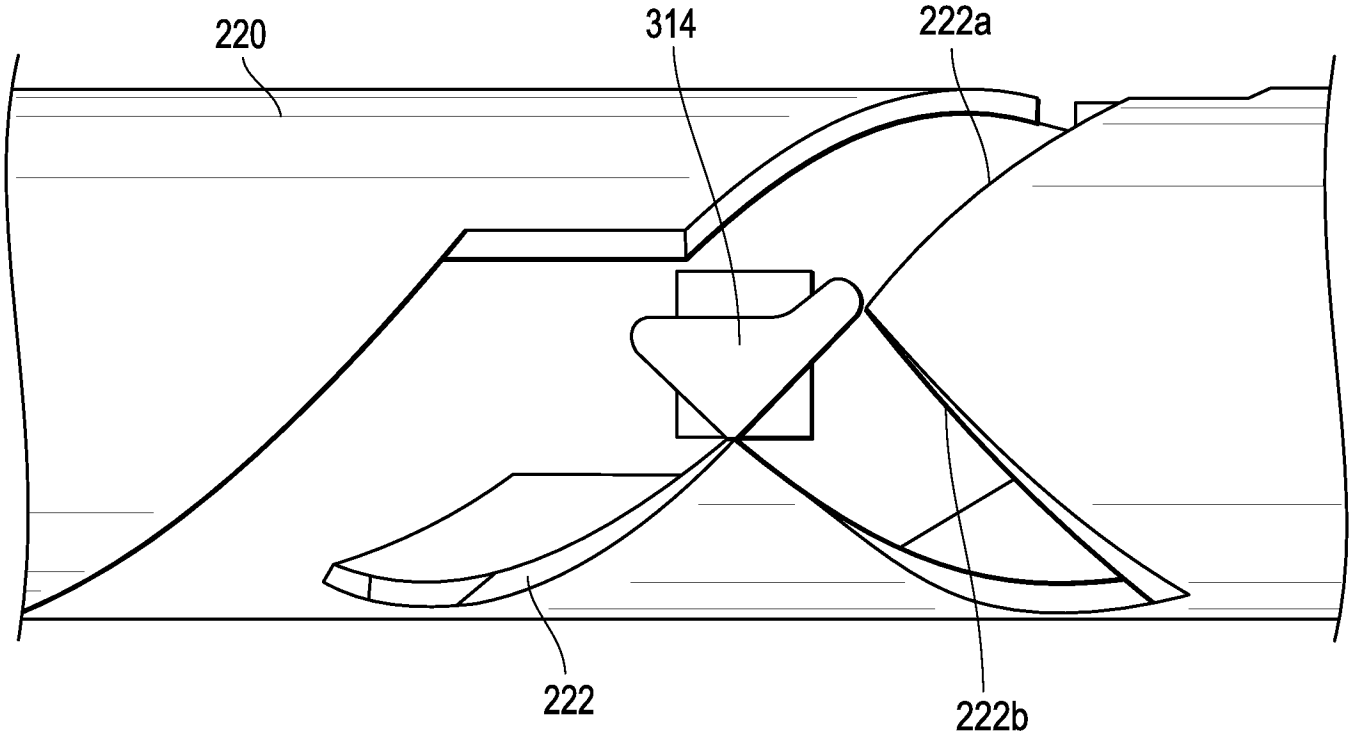
FIG. 12 is a partial view of embodiment of an adjustable selector tool within a downhole adjustable steam injection mandrel tool.

Following transitioning the AST 300 to the third configuration, the AST 300 may be conveyed downwardly through the axial flow bore 248 of the DASIM 200. Referring to the embodiment of FIG. 12, as the AST 300 is conveyed downward through the axial flow bore 248 of the DASIM 200, the selector key 314 may engage the helical slot 222 of the inner mandrel 220. In such an embodiment, the selector key 314 (e.g., the engagement portion 330) may be confined within the helical slot 222 and the helical slot 222 may guide the selector key 314 as the AST 300 conveyed downwardly. As such, the selector 314 may comprise a suitable profile to be guided to the ratchet mechanism 250 via one of the decision paths (e.g., decision path 222*a* or decision path 222*b*) of the helical slot 222 and thereby engages the ratchet mechanism 250. In an embodiment, the decision paths (e.g., decision path 222*a* or decision path 222*b*) may each provide a guided path having a different width. For example, the decision path 222*a* may be generally defined as having a guide path wider than the decision path 222*b*. As such, the selector key 314 may be sized such that the selector key 314 follow the decision path 222*a* (e.g., to the first continuous slot 270) and unable to enter and/or follow decision path 222*b* (e.g., to the second continuous slot 272).

Upon the engagement of the selector key 314 and the ratchet mechanism 250, the AST 300 may actuate the ratchet mechanism 250, for example, for the purpose of adjusting the flow rate of the DASIM 200 (e.g., via opening or closing the ports 212 of the DASIM 200). For example, the AST 300 may oscillate between moving in an upwardly direction (e.g., an up-hole direction) and a downwardly direction (e.g., a down-hole direction) such that the selector key 314 oscillates within one of the continuous slots (e.g., the first continuous slot 270 or the second continuous slot 272). In such an embodiment, the selector key 314 may engage the continuous slots and may apply a sufficient force to actuate (e.g., to rotate) the ratchet mechanism 250 in the first direction or the second direction. For example, the AST 300 may actuate the ratchet mechanism 250 to rotate one or more partial or complete cycles or revolutions. As such, actuation of the ratchet mechanism 250 may cause the DASIM 200 to rotate in the second direction to transition towards the first configuration (e.g., a more restrictive configuration) or to rotate in the first direction to transition towards the third configuration (e.g., a less restrictive configuration). In an embodiment, the AST 300 may actuate the DASIM 200 until configuring the DASIM 200 to provide a desired resistance to fluid flow.

In an embodiment, upon adjusting the DASIM 200 to a desired setting, the AST 300 may be removed from the DASIM 200 and/or the wellbore 114. In an embodiment, the AST 300 may be pulled in an upwardly (e.g., up-hole) direction with a sufficient force to move the first housing portion 302 in the direction of the second position with respect to the second housing portion 312 and thereby transition the first housing portion 302 to the second position with respect to the second housing portion 312. For example, the selector key 314 (e.g., the engagement portion 330) may engage a continuous profile of the ratchet mechanism 250 and may generate a lateral tension (e.g., a stretching force) along the longitudinal axis 500 of the AST 300. In such an embodiment, upon transitioning the first housing portion 302 to the second position with respect to the second housing portion 312, the first housing portion 302 may transition the selector key 314 from the extended position to the retracted position, as previously disclosed. Additionally, upon transitioning the first housing portion 302 to the second position with respect to the second housing portion 312, the locking pin 310 may engage the locking pin bore 308 and thereby transition the locking pin 310 from the retracted position to the extended position. In such an embodiment, the first housing portion 302 the engagement of the locking pin 310 and the locking pin bore 308 may retain the first housing portion 302 in the second position with respect to the second housing portion 312 and thereby transitions the AST 300 from the third configuration to the fourth configuration. Upon transitioning the AST 300 to the fourth configuration, the AST 300 may be retracted (e.g., pulled) through the axial flow bore 126 of the tubular string 112 to the surface 104.

In an embodiment, one or more additional DASIM 200 may be adjusted. For example, upon retrieving the AST 300 from the wellbore 114, the AST 300 may be transitioned from the fourth configuration to the first configuration. In an embodiment, the locking pin 310 may be transitioned from the extracted position to the retracted position, for example, via an application of force onto the locking pin 310 in the direction of the retracted position via the locking pin bore 308. In such an embodiment, upon the transitioning of the locking pin 310 to the retracted position, the first housing portion 320 may transition to the first position with respect to the second housing portion 312. Additionally, the selector key 314 may be interchanged to achieve the desired effect for the subsequent DASIM. The selector key 314 may be transitioned from the extracted position to the retracted position, for example, via an application of force onto the selector key 314 in the direction of the retracted position, and the sliding catch 324 may also be transitioned from the third position to the first position with respect to the third housing portion 304. In such an embodiment, the sliding collar 320 may transition to the first position with respect to the third housing portion 304 in response to transition the sliding catch 324 from the third position to the first position with respect to the third housing portion 304 and thereby may configure the AST 300 to retain the selector key 314 in the retracted position, for example, via the engagement of the retaining lip 316 and the retaining lip catch 318, as previously disclosed. As such, the AST 300 may be configured in the first configuration for one or more additional wellbore servicing operations (e.g., actuating one or more DASIMs).

Additionally, in an embodiment the AST 300 may be reintroduced into the wellbore 114 and/or the tubular string 112 and may engage and actuate a DASIM using methods similar to those previously disclosed. For example, the AST 300 may transition from the first configuration to the second configuration while being conveyed through the tubular string 112, transition from the second configuration to the third configuration to actuate the DASIM, and transition from the third configuration to the fourth configuration to return to the surface. As such, the AST 300 may be employed to adjust and/or configure any number of DASIM, as will be appreciated by one of ordinary skill in the art upon viewing this disclosure.

In an embodiment, when communicating a fluid via the DASIM 408, upon configuring the one or more DASIMs 200 to a desired fluid flow rate, the wellbore servicing operation may further comprise communicating a wellbore servicing fluid, for example, for the purposes of performing a formation stimulation operation via one or more wellbore servicing tools (e.g., DASIM 200) incorporated within the tubular string. For example, a fluid (e.g., water, steam, etc.) may be introduced at a desired pressure to the axial flow bore 126 of the tubular string 112, for example, via one or more pumps located at the surface 104. As such, the fluid will be communicated via the tubular string 112 and released into one or more zones of the subterranean formation 102 via one or more DASIMs 200. Additionally, condensation and/or moisture formed during such a wellbore servicing operation may be captured (e.g., via the ported cover 224 of the inner mandrel 220) and utilized (e.g., communicated to the subterranean formation 102) by the DASIM 200.

In an embodiment, a DASIM 200, a system comprising a DASIM 200, and/or a wellbore servicing method employing such a system and/or a DASIM 200, as disclosed herein or in some portion thereof, may be advantageously employed to provide an adjustable fluid flow rate and to improve wellbore servicing operation efficiency. For example, in an embodiment, a DASIM like DASIM 200 enables a wellbore servicing system to provide an adjustable fluid flow rate once installed (e.g., within a wellbore) for one or more wellbore servicing operations (e.g., wellbore stimulation). Conventional tools may not have to ability to provide a finely adjustable fluid flow rate once installed within a wellbore. Additionally, a DASIM 200 enables condensation formed during a wellbore servicing operation, for example, a steam injection operation, to be utilized during the wellbore servicing operation. Conventional tools may be unable to capture and/or to utilize condensation formed during a steam injection operation which may lead to inefficiency and water deposits within a wellbore and/or thermal gradients along a wellbore. Therefore, the methods disclosed herein provide a means by which to adjust selectively adjust a fluid flowrate of a down-hole wellbore servicing tool and to improve a wellbore servicing operation by capturing and/or utilizing condensation formed during the wellbore servicing operation.

Additional Disclosure

The following are non-limiting, specific embodiments in accordance with the present disclosure:

In a first embodiment, a steam injection mandrel comprises a housing generally defining an axial flow bore and comprising one or more ports, an inner mandrel disposed within the housing, and a slot formed in the inner mandrel, wherein the slot transitions at least three hundred sixty degrees about the longitudinal axis of the housing, wherein the steam injection mandrel is configured to provide fluid communication between the axial flow bore and the one or more ports through the slot.

A second embodiment may include the steam injection mandrel of the first embodiment, further comprising: an annular region defined between an interior surface of the housing and an exterior surface of the inner mandrel; and a valve sleeve disposed within the annular region, wherein the valve sleeve is configured to selectively adjust a resistance to fluid flow between the axial flow bore and the one or more ports.

A third embodiment may include the steam injection mandrel of the second embodiment, wherein the valve sleeve is configured to be positioned to partially restrict or substantially restrict a route of fluid communication via the ports.

A fourth embodiment may include the steam injection mandrel of any of the first to third embodiments, wherein the slot formed in the inner mandrel comprises a helical slot.

A fifth embodiment may include the steam injection mandrel of the fourth embodiment, wherein the helical slot comprises a ported cover.

A sixth embodiment may include the steam injection mandrel of any of the first to fifth embodiments, further comprising an adjustment mechanism coupled to the valve sleeve, wherein the adjustment mechanism is configured to position the valve sleeve.

A seventh embodiment may include the steam injection mandrel of the sixth embodiment, wherein the adjustment mechanism comprises a ratchet mechanism comprising a plurality of continuous slots.

An eighth embodiment may include the steam injection mandrel of the seventh embodiment, wherein the slot comprises one or more decision paths, and wherein the slot is configured to guide an adjustment tool into engagement with the ratchet mechanism.

A ninth embodiment may include the steam injection mandrel of any of the sixth to eighth embodiments, wherein the adjustment mechanism comprises a continuous j-slot coupled to a valve sleeve, wherein the valve sleeve is configured to selectively adjust a resistance to fluid flow between the axial flow bore and the one or more ports.

A tenth embodiment may include the steam injection mandrel of any of the first to ninth embodiments, wherein the one or more ports are in fluid communication with an exterior of the steam injection mandrel.

In an eleventh embodiment, a wellbore system comprises a tubular string having an axial flow bore disposed in a wellbore within a subterranean formation, and a downhole adjustable steam injection mandrel coupled to the tubular string, wherein the downhole adjustable steam injection mandrel comprises an adjustment mechanism comprising a plurality of continuous slots coupled to a valve sleeve, wherein the valve sleeve is configured to selectively adjust a resistance to fluid flow between the axial flow bore and the subterranean formation.

A twelfth embodiment may include the steam injection mandrel of the eleventh embodiment, wherein the axial flow bore is configured to receive an adjustable selector tool, and wherein the adjustable selector tool is configured to engage one of the plurality of continuous slots and selectively increase or decrease the resistance to fluid flow between the axial flow bore and the subterranean formation.

A thirteenth embodiment may include the steam injection mandrel of the eleventh or twelfth embodiment, further comprise one or more packers disposed about the tubular string, wherein the one or more packers are configured to isolate one or more portions of the wellbore.

A fourteenth embodiment may include the steam injection mandrel of any of the eleventh to thirteenth embodiments, wherein the adjustment mechanism comprises a ratchet mechanism that is configured to rotate in response to an axial cycling of an adjustable selector tool.

A fifteenth embodiment may include the steam injection mandrel of the fourteenth embodiment, wherein the valve sleeve is configured to axial translate in response to a rotation of the ratchet mechanism.

In a sixteenth embodiment, a wellbore servicing method comprises disposing an adjustable selector tool within an axial flow bore of a downhole adjustable steam injection mandrel, engaging a continuous slot in an adjustment mechanism, rotating the adjustment mechanism using the adjustable selector tool, and selectively adjusting a resistance to the flow of a fluid between the axial flow bore and a subterranean formation in response to rotating the adjustment mechanism.

A seventeenth embodiment may include the steam injection mandrel of the sixteenth embodiment, wherein engaging the continuous slot in the adjustment mechanism comprises: engaging the adjustable selector tool with a helical slot disposed in an inner mandrel of the downhole adjustable steam injection mandrel; and guiding the adjustable selector tool into engagement with the continuous slot using the helical slot.

An eighteenth embodiment may include the steam injection mandrel of the seventeenth embodiment, wherein the adjustment mechanism comprises a second continuous slot, and wherein guiding the adjustable selector tool into engagement with the continuous slot using the helical slot comprises: traversing one or more decision paths leading to the second continuous slot.

A nineteenth embodiment may include the steam injection mandrel of any of the sixteenth to eighteenth embodiments, wherein rotating the adjustment mechanism comprises: axially cycling the adjustment mechanism; and rotating the adjustment mechanism in response to the axial cycling.

A twentieth embodiment may include the steam injection mandrel of any of the sixteenth to nineteenth embodiments, further comprising: passing any liquid flowing along an interior surface of the axial flow bore through an axial discontinuity in an inner mandrel of the downhole adjustable steam injection mandrel.

A twenty first embodiment may include the steam injection mandrel of the twentieth embodiment, wherein the axial discontinuity comprises a helical slot disposed in the inner mandrel.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, R1, and an upper limit, Ru, is disclosed, any number falling within the range is specifically disclosed. In particular, the following numbers within the range are specifically disclosed: $R=R1+k*(Ru-R1)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A steam injection mandrel comprising:

a housing generally defining an axial flow bore and comprising one or more ports;

an inner mandrel disposed within the housing;

a slot formed in the inner mandrel, wherein the slot transitions at least three hundred sixty degrees about the longitudinal axis of the housing, wherein the slot provides a route of fluid communication from the axial flow bore through the slot and to an exterior of the inner mandrel such that the steam injection mandrel is configured to provide fluid communication between the axial flow bore and the one or more ports through the slot; an annular region defined between an interior surface of the housing and an exterior surface of the inner mandrel;

and a valve sleeve disposed within and movable within the annular region, wherein the valve sleeve is configured to selectively adjust a resistance to fluid flow between the axial flow bore and the one or more ports.

2. The steam injection mandrel of claim 1, wherein the valve sleeve is configured to be positioned to partially restrict or substantially restrict a route of fluid communication via the ports.

3. The steam injection mandrel of claim 1, wherein the slot formed in the inner mandrel comprises a helical slot.

4. The steam injection mandrel of claim 3, wherein the helical slot comprises a ported cover comprising a plurality of holes, perforations, or ports configured to communicate fluid therethrough.

5. The steam injection mandrel of claim 1, further comprising an adjustment mechanism coupled to a valve sleeve, wherein the adjustment mechanism is configured to position the valve sleeve.

6. The steam injection mandrel of claim 5, wherein the adjustment mechanism comprises a ratchet mechanism comprising a plurality of continuous slots.

7. The steam injection mandrel of claim 6, wherein the slot formed in the inner mandrel comprises one or more decision paths, and wherein the slot formed in the inner mandrel is configured to guide an adjustment tool into engagement with the ratchet mechanism having the plurality of continuous slots.

8. The steam injection mandrel of claim 5, wherein the adjustment mechanism comprises a continuous j-slot coupled to the valve sleeve, wherein the valve sleeve is movable relative to the housing to selectively adjust a resistance to fluid flow between the axial flow bore and the one or more ports.

9. The steam injection mandrel of claim 1, wherein the one or more ports are in fluid communication with an exterior of the steam injection mandrel.

10. A wellbore system comprising:

a tubular string having an axial flow bore disposed in a wellbore within a subterranean formation; and a downhole adjustable steam injection mandrel coupled to the tubular string, wherein the downhole adjustable steam injection mandrel comprises an adjustment mechanism comprising a plurality of continuous slots coupled to a valve sleeve, wherein the valve sleeve is configured to selectively adjust a resistance to fluid flow between the axial flow bore and the subterranean formation;

wherein the axial flow bore of the tubular string is configured to receive an adjustable selector tool that is separate from the downhole adjustable steam injection mandrel as the adjustable selector tool is lowered through the axial flow bore from the surface to the downhole adjustable steam injection mandrel, wherein the adjustable selector tool is configured to directly engage one of the plurality of continuous slots and selectively increase or decrease the resistance to fluid flow between the axial flow bore and the subterranean formation.

11. The system of claim 10, further comprise one or more packers disposed about the tubular string, wherein the one or more packers are configured to isolate one or more portions of the wellbore.

12. The system of claim 10, wherein the adjustment mechanism comprises a ratchet mechanism that is configured to rotate in response to an axial cycling of an adjustable selector tool.

13. The system of claim 12, wherein the valve sleeve is configured to axially translate in response to a rotation of the ratchet mechanism.

14. The wellbore system of claim 10, wherein the adjustment mechanism comprises a ratchet mechanism and wherein each of the continuous slots in the adjustment mechanism comprise a slot extending entirely about a circumference of the ratchet mechanism.

15. A wellbore servicing method comprising:

lowering an adjustable selector tool from a surface of a well through an axial flow bore of a tubular string in the well and into an axial flow bore of a downhole adjustable steam injection mandrel coupled to the tubular string;

engaging the adjustable selector tool with a continuous slot in an adjustment mechanism within the downhole adjustable steam injection mandrel;

rotating the adjustment mechanism using the adjustable selector tool engaged with the continuous slot; and selectively adjusting a resistance to the flow of a fluid between the axial flow bore and a subterranean formation in response to rotating the adjustment mechanism.

16. The method of claim 15, wherein engaging the continuous slot in the adjustment mechanism comprises:

engaging the adjustable selector tool with a helical slot disposed in an inner mandrel of the downhole adjustable steam injection mandrel, wherein the inner mandrel is separate from the adjustment mechanism; and guiding the adjustable selector tool into engagement with the continuous slot of the adjustment mechanism using the helical slot of the inner mandrel.

17. The method of claim 16, wherein the adjustment mechanism comprises a second continuous slot, and wherein guiding the adjustable selector tool into engagement with the continuous slot using the helical slot comprises traversing one or more decision paths along the helical slot leading from the helical slot to the second continuous slot.

18. The method of claim 15, wherein rotating the adjustment mechanism comprises: axially cycling the adjustment mechanism; and rotating the adjustment mechanism in response to the axial cycling.

19. The method of claim 15, further comprising: passing any liquid flowing along an interior surface of the axial flow bore through an axial discontinuity in an inner mandrel of the downhole adjustable steam injection mandrel.

20. The method of claim 19, wherein the axial discontinuity comprises a helical slot disposed in the inner mandrel.

* * * * *